US008213830B2

(12) United States Patent
Nakashima

(10) Patent No.: US 8,213,830 B2
(45) Date of Patent: Jul. 3, 2012

(54) IMAGE FORMING APPARATUS IN WHICH DEVELOPER CARRYING MEMBERS CAN BE SEPARATED FROM PHOTOSENSITIVE MEMBERS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 624 days.

(21) Appl. No.: 12/340,897

(22) Filed: Dec. 22, 2008

(65) Prior Publication Data

US 2009/0252530 A1 Oct. 8, 2009

(30) Foreign Application Priority Data

Dec. 28, 2007 (JP) ..... 2007-340750

(51) Int. Cl.
*G03G 15/08* (2006.01)
*G03G 21/18* (2006.01)

(52) U.S. Cl. ..... 399/111; 399/119; 399/223

(58) Field of Classification Search ..... 399/111, 399/113, 119, 223
See application file for complete search history.

(56) References Cited

U.S. PATENT DOCUMENTS

| | | | | |
|---|---|---|---|---|
| 6,795,671 | B2 | 9/2004 | Matsuoka | |
| 7,463,844 | B2 * | 12/2008 | Hashimoto et al. | 399/111 |
| 7,512,361 | B2 * | 3/2009 | Kawamura et al. | 399/111 |
| 7,565,093 | B2 | 7/2009 | Okabe et al. | |
| 7,869,740 | B2 * | 1/2011 | Yoshimura et al. | 399/111 |
| 7,925,181 | B2 * | 4/2011 | Hattori et al. | 399/111 |
| 2006/0083545 | A1 | 4/2006 | Okabe et al. | |

FOREIGN PATENT DOCUMENTS

| | | | |
|---|---|---|---|
| JP | 05-232789 | A | 9/1993 |
| JP | 08-123281 | A | 5/1996 |
| JP | 2002-006716 | | 1/2002 |
| JP | 2002-099129 | A | 4/2002 |
| JP | 2003-215876 | | 7/2003 |
| JP | 2006-119219 | A | 5/2006 |
| JP | 2006-337413 | A | 12/2006 |

OTHER PUBLICATIONS

JP Notification of Reasons for Refusal dated Oct. 18, 2011, corresponding Application No. 2007-340750; English Translation.
JP Decision of Grant dtd Jan. 5, 2012, JP Appln. 2007-340750, English Translation.

* cited by examiner

*Primary Examiner* — William J Royer
(74) *Attorney, Agent, or Firm* — Banner & Witcoff, Ltd.

(57) ABSTRACT

An image forming apparatus includes an apparatus body, and a process cartridge removably mounted to the apparatus body. The process cartridge includes a photosensitive cartridge including a photosensitive member, and a developing cartridge including a developer carrying member, which is contactable with the photosensitive member, and which carries developer. The image forming apparatus further includes a first pressing member that presses the photosensitive cartridge in a first direction with respect to a positioning portion that is provided on the apparatus body, and a separating member that includes a second pressing member that acts in a second direction and thereby causes the developer carrying member to separate from the photosensitive member. The first direction and the second direction are substantially the same.

17 Claims, 14 Drawing Sheets

IMAGE FORMING APPARATUS IN WHICH DEVELOPER CARRYING MEMBERS CAN BE SEPARATED FROM PHOTOSENSITIVE MEMBERS

CROSS-REFERENCE TO RELATED APPLICATIONS

This application claims priority from Japanese Patent Application No. 2007-340750 filed on Dec. 28, 2007, the entire subject matter of which is incorporated herein by reference.

TECHNICAL FIELD

Aspects of the invention relate to an image forming apparatus.

BACKGROUND

There has been proposed a printer that forms an image electrophotographically, in which a process cartridge is removably mounted to an apparatus body. The process cartridge includes a developing cartridge having a developing roller and a photosensitive cartridge to which the developing cartridge is removably mounted and which has a photosensitive drum.

The process cartridge is pressed in a constant direction for positioning when it is mounted to the apparatus body. In addition, there has been also proposed a printer which brings a developing roller into contact with a photosensitive drum when forming an image, and separates the developing roller from the photosensitive drum when an image is not being forming.

For example, JP-A-2003-215876 describes a related image forming apparatus which positions a process cartridge on the apparatus body by pressing a bearing of a photosensitive drum downward by a twist coil spring such that the bearing is pressing against a butting surface of a guide groove.

In the related image forming apparatus, a switching means for separating the developing roller from the photosensitive drum is provided. The switching means separates the developing roller from the photosensitive drum by pressing-up a rib provided on the developing unit using a separating plate.

SUMMARY

Illustrative aspects of the invention provide an image forming apparatus which, even when developer carrying members are separated from photosensitive members, can suppress positional deviations and vibrations of process cartridges with respect to the apparatus body, prevent deterioration of image forming accuracy, and shorten the correction time when forming an image.

DETAILED DESCRIPTION

<General Overview>

Figure 1:
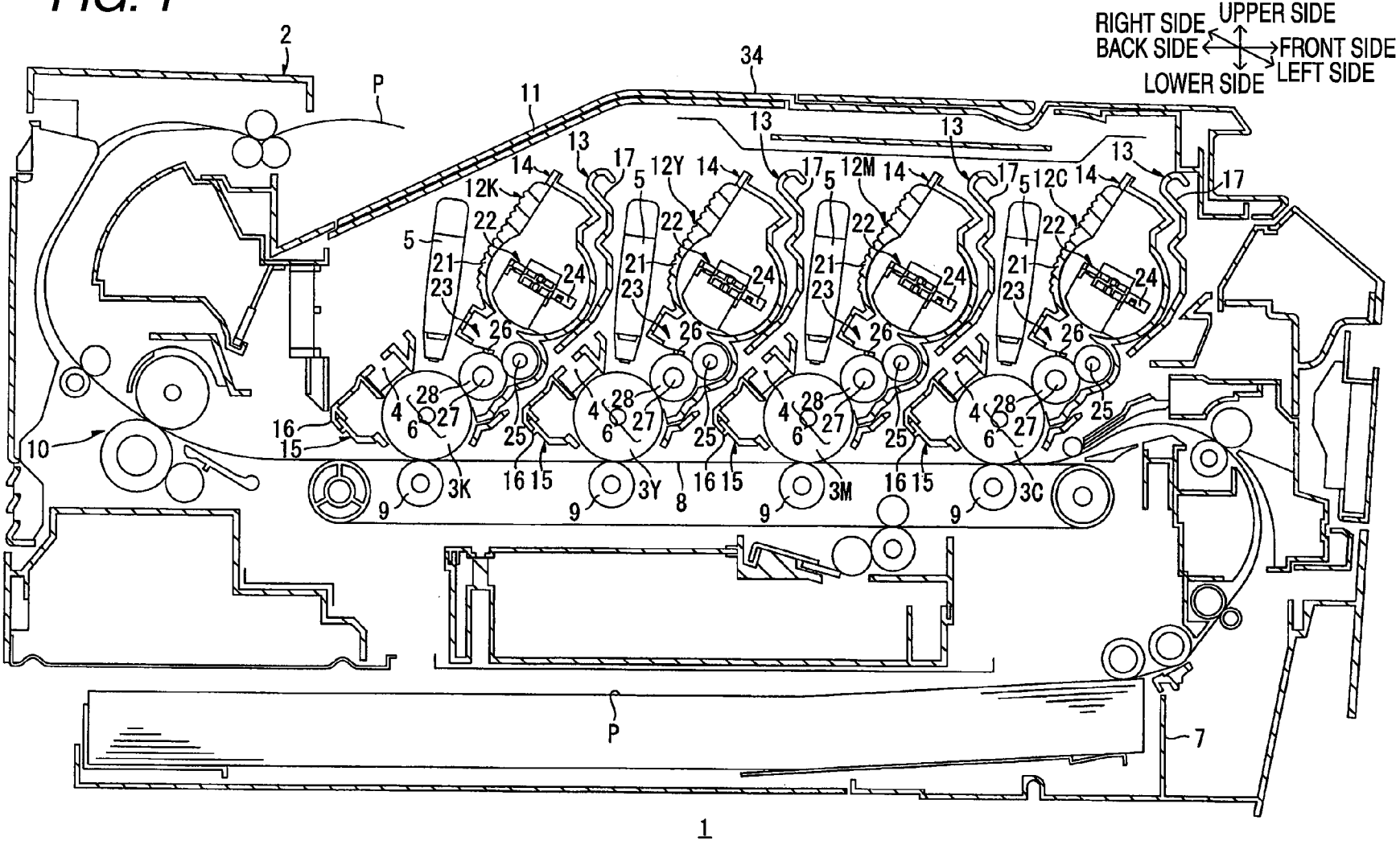
FIG. 1 is a side sectional view showing an image forming apparatus according to an exemplary embodiment of the invention.

The related image forming apparatus described above has some disadvantages. For example, a direction of pressing the process cartridge to position the process cartridge on the apparatus body and a direction of pressing the developing unit to separate the developing roller from the photosensitive drum are reverse to each other.

In this case, after the process cartridge is positioned on the apparatus body, when the developing unit is pressed in the opposite direction so as to separate the developing roller from the photosensitive drum, the process cartridge may be displaced from the apparatus body or may vibrate. If the process cartridge is displaced from the apparatus body, it deteriorates the image forming accuracy. If vibration occurs, an excessive correction time is required when forming an image.

Accordingly, illustrative aspects of the invention provide an image forming apparatus which, even when developer carrying members are separated from photosensitive members, can suppress positional deviations and vibrations of process cartridges with respect to the apparatus body, prevent deterioration of image forming accuracy, and shorten the correction time when forming an image.

According to a first illustrative aspect of the invention, there is provided an image forming apparatus comprising: an apparatus body; a process cartridge that is removably mounted to the apparatus body and comprises: a photosensitive cartridge comprising a photosensitive member; and a developing cartridge comprising a developer carrying member, which is contactable with the photosensitive member, and which carries developer; a first pressing member that presses the photosensitive cartridge in a first direction with respect to a positioning portion that is provided on the apparatus body; and a separating member that comprises a second pressing member that acts in a second direction and thereby causes the developer carrying member to separate from the photosensitive member, wherein the first direction and the second direction are substantially the same.

According to a second illustrative aspect of the invention, there is provided an image forming apparatus comprising: an apparatus body; a plurality of process cartridges that are removably mounted to the apparatus body, each of the plurality of process cartridges comprising: a photosensitive cartridge comprising a photosensitive member; and a developing cartridge, which is removably mounted in the photosensitive cartridge, and which comprises a developer carrying member, which is contactable with the photosensitive member and carries developer; a plurality of first pressing members that are provided on the apparatus body and that correspond to the plurality of photosensitive cartridges, each of the first pressing members pressing its corresponding photosensitive cartridge into the apparatus body to secure the corresponding photosensitive cartridge in the apparatus body; a side plate that is provided outside of the process cartridge; an elongated member that is attached to an outside of the side plate and extends along the plurality of process cartridges in a direction orthogonal to a direction of the axes of the photosensitive members; and a plurality of second pressing members, which correspond to the plurality of process cartridges, each second pressing member being positioned along the elongated member so as to, when actuated, causing the developer carrying member to separate from the photosensitive member.

According to a third illustrative aspect of the invention, there is provided an image forming apparatus comprising: an apparatus body; a process cartridge that is removably mounted to the apparatus body and comprises: a photosensitive cartridge comprising a photosensitive member; and a developing cartridge comprising a developer carrying member, which is contactable with the photosensitive member, and which carries developer; and a separating member that comprises a pressing member that acts in a first direction to cause the developer carrying member to separate from the photosensitive member in a second direction, wherein the first direction is substantially opposite to the second direction.

<Illustrative Aspects>

Illustrative aspects of the invention will now be described with reference to the drawings.

(Image Forming Apparatus)

FIG. 1 is a side sectional view showing an image forming apparatus of the present invention. In the following description, the direction of horizontal placing is set as a reference, and in detail, the arrow directions shown in the respective drawings are set as a reference. The right-left direction and the width direction are the same.

A direct tandem type color light emitting diode (LED) printer is one example of the image forming apparatus 1. As shown in FIG. 1, inside a body casing 2 as an example of an apparatus body of the image forming apparatus 1, four photosensitive drums 3 as an example of photosensitive members are arranged in parallel along the front-back direction.

In the description given below, four photosensitive drums 3 are distinguished as a photosensitive drum 3K (black), a photosensitive drum 3Y (yellow), a photosensitive drum 3M (magenta), and a photosensitive drum 3C (cyan) corresponding to the colors (black, yellow, magenta, and cyan) of developer images (described later). Around each photosensitive drum 3, a scorotron-type charger 4, an LED unit 5, and a developing roller 6 as an example of a developer carrying member are opposed to each other.

The surfaces of the photosensitive drums 3 are evenly charged by the scorotron-type chargers 4, and then exposed to light irradiated from the LED units 5 as exposure units. Accordingly, on the surfaces of the photosensitive drums 3, electrostatic latent images based on image data are formed. The electrostatic latent images are visualized by developer carried by the developing rollers 6 and developer images are formed on the surfaces of the photosensitive drums 3.

Sheets P are housed in a sheet feeding cassette 7 inside the body casing 2. The sheets P housed in the sheet feeding cassette 7 are fed to a conveyor belt 8 by various rollers.

The conveyor belt 8 is arranged between the photosensitive drums 3K, 3Y, 3M, and 3C and transfer rollers 9 opposed respectively to these photosensitive drums 3. Developer images on the surfaces of the photosensitive drums 3 are transferred onto a sheet P conveyed by the conveyor belt 8 by a transfer bias applied to the transfer rollers 9, and superimposed sequentially.

After four-color developer images are transferred onto the sheet P, the sheet P is conveyed to a fixing part 10. The developer images transferred onto the sheet P are heat-fixed at the fixing part 10. Thereafter, the sheet P is discharged into a sheet discharge tray 11 by various rollers.

(Process Cartridge)

The image forming apparatus 1 includes four process cartridges 12 corresponding to the respective colors. Hereinafter, the four process cartridges 12 are distinguished as a process cartridge 12K (black), a process cartridge 12Y (yellow), a process cartridge 12M (magenta), and a process cartridge 12C (cyan) corresponding to the respective colors. The process cartridges 12 are removably mounted inside the body casing 2, and are arranged in parallel in one direction along the front-back direction.

In other words, the four process cartridges 12 are arranged in the body casing 2 in order of, from back to front, the process cartridge 12K, the process cartridge 12Y, the process cartridge 12M, and the process cartridge 12C.

Each process cartridge 12 includes a drum cartridge 13 as an example of a photosensitive cartridge and a developing cartridge 14 which is removably mounted to the drum cartridge 13.

On the upper wall of the body casing 2, a top cover 34 is provided so as to open and close, and by opening the top cover 34, the process cartridges 12 can be mounted and removed inside the body casing 2.

(1) Drum Cartridge

The drum cartridge 13 includes a drum frame 15. The drum frame 15 includes a drum support part 16 arranged on the lower back side, and a developing cartridge housing 17 arranged on the upper front side. On the drum support part 16, the photosensitive drum 3 and a scorotron-type charger 4 are arranged on the upper back side such that the scorotron-type charger 4 is spaced apart from the photosensitive drum 3.

Figure 2:
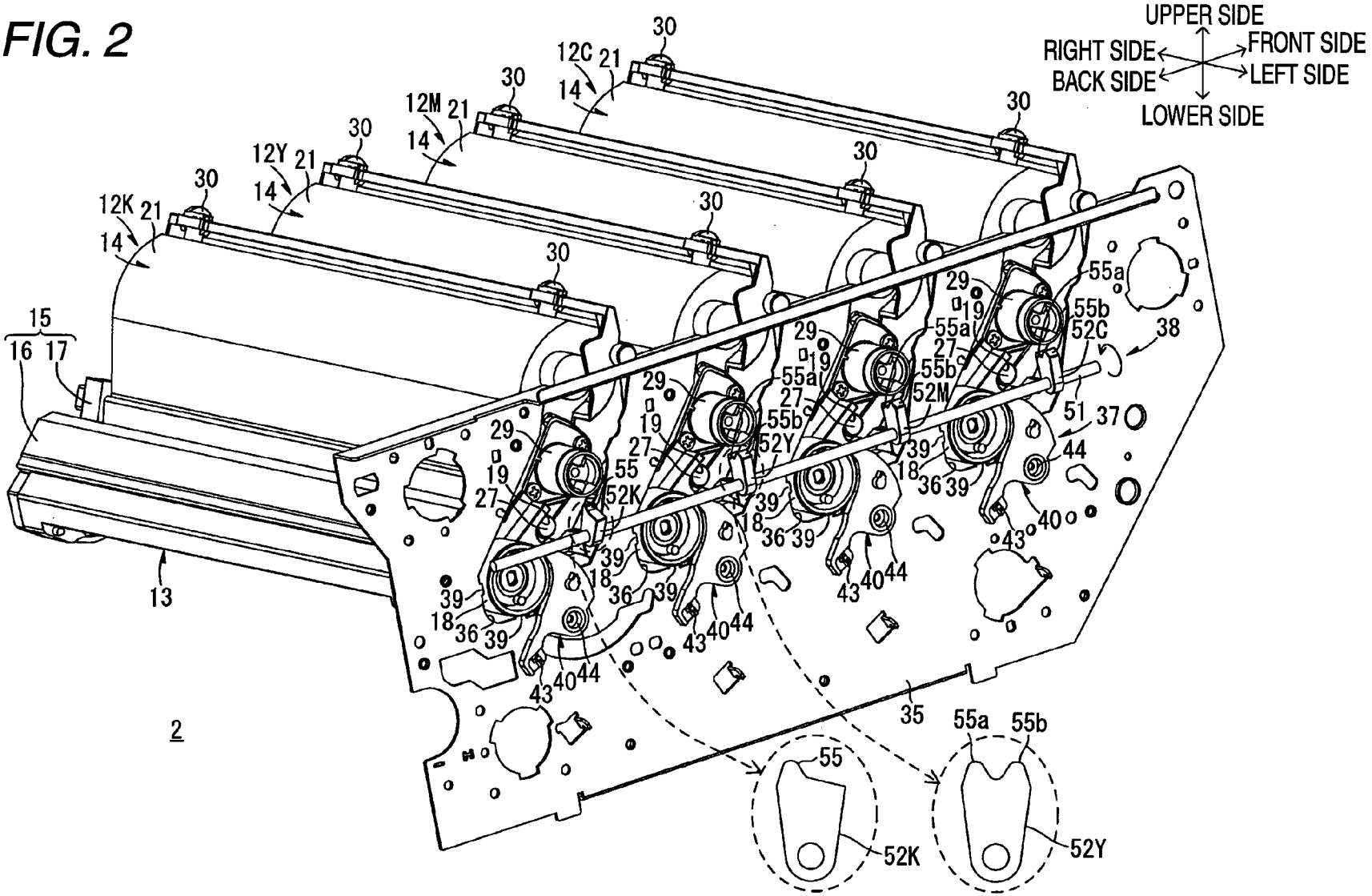
FIG. 2 is a perspective view of a body casing of the image forming apparatus of FIG. 1 as viewed from a back-left side.

The drum support part 16 is provide with a drum side input coupling 18 which receives a driving force to be inputted into the photosensitive drum 3 (see FIG. 2). The drum side input coupling 18 is provided so as to project leftward from the drum support part 16.

When the process cartridge 12 is mounted to the body casing 2, a drum side output coupling (not shown) provided on the body casing 2 is advanced toward the drum side input coupling 18 in conjunction with closing the top cover 34 and is fitted to the drum side input coupling 18. A driving force outputted from the drum side output coupling (not shown) is transmitted to the photosensitive drum 3 through the drum side input coupling 18, and accordingly, the photosensitive drum 3 is rotated.

The drum side output coupling (not shown) is withdrawn from the drum side input coupling 18 in conjunction with opening of the top cover 34.

On the drum support part 16, shaft guide grooves 19 (see FIG. 2) for guiding a roller shaft 27 (described later) are formed on the upper front side of the drum side input coupling 18.

The shaft guide grooves 19 are formed on both side walls of the drum support part 16 by notching the drum support part from the back end of the drum support part 16 to the lower back side in a substantially U-shape in a side view.

The developing cartridge housing 17 houses the developing cartridge 14 in a removable manner.

(2) Developing Cartridge

The developing cartridge 14 includes a housing 21. The housing 21 has a box shape whose lower back side is opened. In the housing 21, the upper front side space is sectioned as a developer accommodation chamber 22 for accommodating developer, and the lower back side space is sectioned as a developing chamber 23 in which the developing roller 6 is provided.

The developer accommodation chamber 22 is filled with the developer. An agitator 24 is provided rotatably in the developer accommodation chamber 22.

In the developing chamber 23, a supply roller 25 and a layer thickness restricting blade 26 are provided together with the developing roller 6.

The developing roller 6 is supported rotatably at the lower end portion of the back side of the housing 21 so as to be exposed from the lower back side of the housing 21. The developing roller 6 has a roller shaft 27 as an example of a protrusion and a rubber roller 28 provided around the roller shaft 27. Both end portions of the roller shaft 27 project to both outer sides in the width direction from the housing 21 (see FIG. 2).

The supply roller 25 is arranged on the upper front side of the developing roller 6 so as to be opposed to the developing roller 6. The layer thickness restricting blade 26 is brought into pressure-contact with the developing roller 6 from above.

In the developing cartridge 14, when forming an image, the developer filled in the developer accommodation chamber 22 is discharged to the developing chamber 23 by rotation of the agitator 24 and is supplied to the supply roller 25. Thereafter, the developer is supplied to the developing roller 6 due to rotation of the supply roller 25. Then, the developer enters between the layer thickness restricting blade 26 and the developing roller 6 in association with the rotation of the developing roller 6 and is formed into a thin layer with a predetermined thickness. Accordingly, the developer is carried as a thin layer on the surface of the developing roller 6.

On the left side surface of the housing 21, a developing side input coupling 29 is provided (see FIG. 2). When the process cartridge 12 is mounted to the body casing 2, a developing side output coupling (not shown) provided on the body casing 2 is advanced toward the developing side input coupling 29 in conjunction with closing of the top cover 34, and fitted to the developing side input coupling 29. A driving force outputted from the developing side output coupling (not shown) is transmitted to the agitator 24, the supply roller 25, and the developing roller 6 through the developing side input coupling 29, and accordingly, the agitator 24, the supply roller 25, and the developing roller 6 are rotated.

The developing side output coupling (not shown) is withdrawn from the developing side input coupling 29 in conjunction with opening of the top cover 34.

At the upper end portion of the housing 21 of each developer cartridge 14, pressed portions 30 to be pressed by the top cover 34 are provided (see FIG. 2). On each housing 21, a plurality of pressed portions 30 (in this exemplary embodiment, two pressed portions) are arranged leaving a space therebetween in the width direction, and project upward from the upper end portion of the housing 21. The pressed portions 30 include springs inside, and are brought into elastic contact with the top cover 34.

The developing cartridge 14 is mounted to the developing cartridge housing 17 by inserting both end portions of the roller shaft 27 into the shaft guide grooves 19 of the drum cartridge 13 and guiding the roller shaft 27 along the shaft guide grooves 19 (see FIG. 2).

When the developing cartridge 14 is mounted to the developing cartridge housing 17 of the drum cartridge 13, the developing roller 6 and the photosensitive drum 3 are arranged and opposed to each other.

(Body Casing)

As shown in FIG. 1, a top cover 34 which is opened and closed in the up-down direction is provided on the upper surface of the body casing 2.

The body casing 2 includes two side plates 35 arranged leaving a space therebetween in the width direction as shown in FIG. 2. Note that, in FIG. 2, one of the side plates 35, i.e., the side plate 35 provided on a right side of the body casing 2, is omitted.

(1) Side Plate

On the side plate 35, guide grooves 36 for guiding the drum side input coupling 18 are formed at four locations corresponding to the process cartridges 12. The guide grooves 36 are formed spaced apart from each other in the front-back direction. Each guide groove 36 is formed by notching diagonally the side plate 35 from an upper end to the lower back side of the side plate 35.

Figure 3:
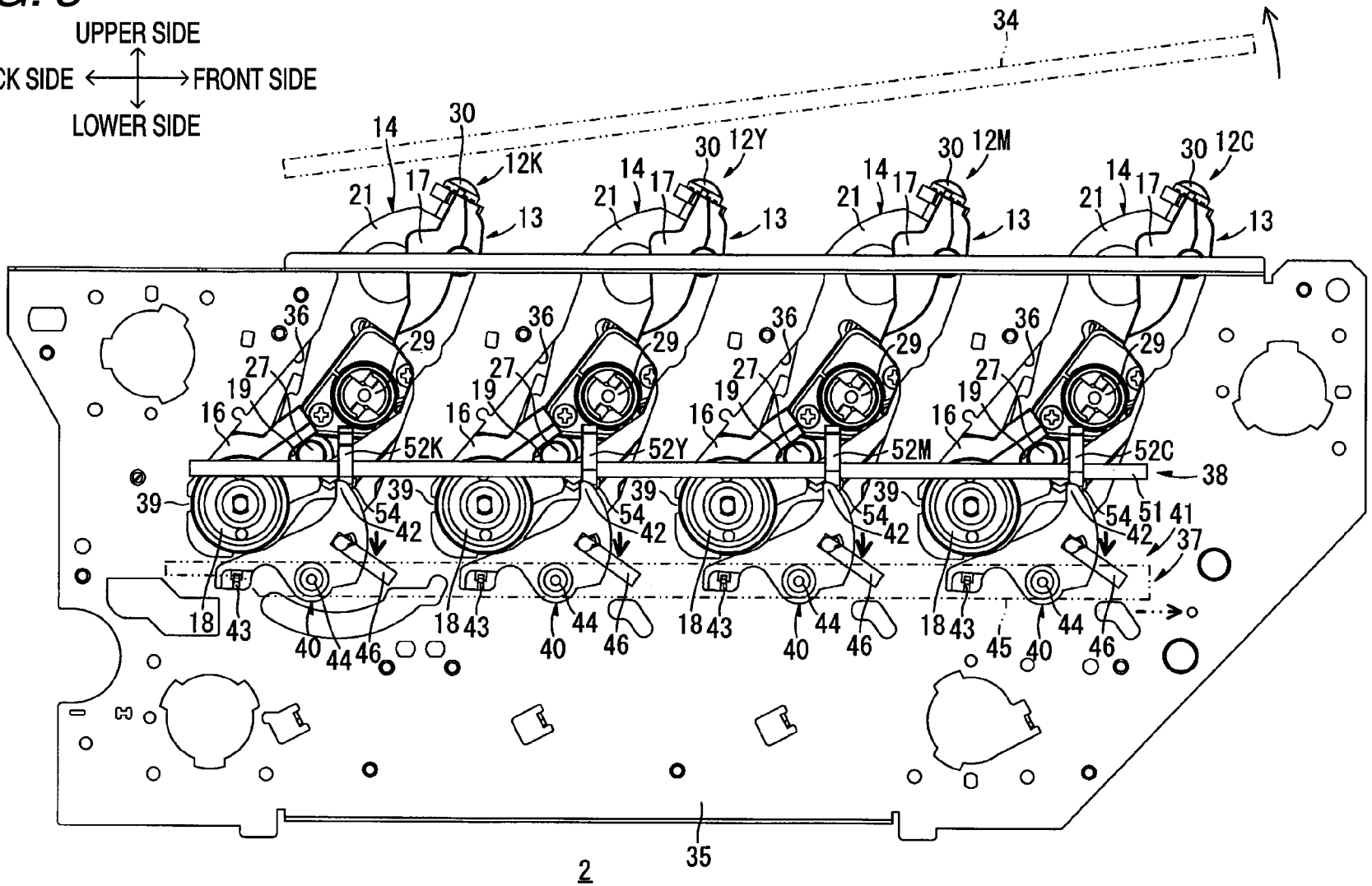
FIG. 3 is a left side view of the body casing of FIG. 2 showing a state in which a top cover of the image forming apparatus is opened.

Each process cartridge 12 is mounted to the body casing 2 by, as shown in FIG. 3, first, opening the top cover 34, inserting the drum side input coupling 18 into the guide grooves 36 from above the body casing 2, and moving the drum side input coupling 18 to the lower back side along the guide grooves 36. Accordingly, the process cartridge 12 is arranged so as to be inclined with respect to the body casing 2 so that the upper end portion turns to the upper front side and the lower end portion turns to the lower back side.

Figure 4:
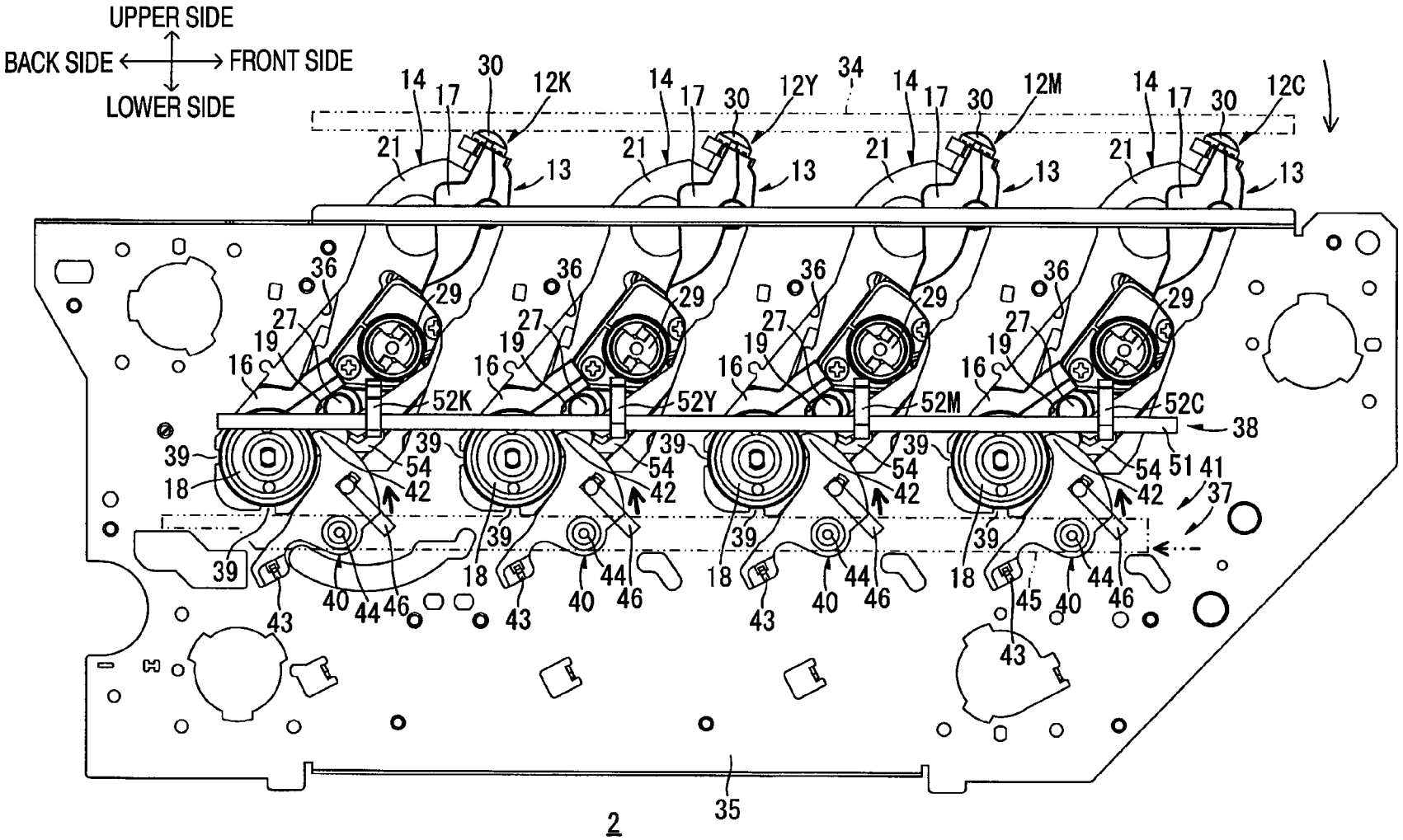
FIG. 4 is a left side view of the body casing of FIG. 2 in a full-color mode showing a state in which the top cover is closed.

Then, as shown in FIG. 4, when the top cover 34 is closed, the lower surface of the top cover 34 presses the pressed portions 30 downward, and accordingly, the developing cartridges 14 are pressed downward by the forces of the pressed portions 30, and normally, the developing rollers 6 and the photosensitive drums 3 are brought into pressure contact with each other.

In the body casing 2, a positioning mechanism 37 for positioning the process cartridges 12, and a separation mechanism 38 as an example of a separating member which presses the roller shafts 27 of the developing cartridges 14 for separating the developing rollers 6 from the photosensitive drums 3, are provided.

(2) Positioning Mechanism

The positioning mechanism 37 includes positioning portions 39 for positioning the process cartridges 12, drum side press levers 40 as an example of a first pressing member which press the process cartridges 12 in the positioning direction (from the upper front side to the lower back side) as an example of a first direction, and a drum side link mechanism 41 which swings the drum side press levers 40.

The positioning portions 39 are provided at two locations on the lower end portion of the guide grooves 36. One positioning portion 39 is formed on the lower end portion of the guide groove 36, as a projection having substantially a rectangular shape in a side view projecting upward from the lower end. Another positioning portion 39 is formed on the lower end portion of the guide groove 36 as a projection having a substantially rectangular shape in a side view projecting forward from the back end.

The drum side press lever 40 is provided at the lower front sides of each guide groove 36. At the upper end portion of the drum side press lever 40, a protrusion 42 projecting to the upper back side is provided. The lower end portion of the drum side press lever 40 is pulled to the lower front side by a tension spring 43 fixed on the side plate 35. The middle portion in the up-down direction of the drum side press lever 40 is supported by a swing shaft 44 so as to swing.

The drum side link mechanism 41 includes a translation cam 45 and a link plate 46. The translation cam 45 has a long and thin plate shape extending in the front-back direction across the four drum side press levers 40, and is arranged and opposed to the left sides of the drum side press levers 40.

The translation cam 45 is supported so as to move linearly in the front-back direction in the body casing 2, and is interlocked with the top cover 34 by a link mechanism not shown. In other words, when the top cover 34 is closed, the translation cam 45 moves linearly backward as shown in FIG. 4, and when the top cover 34 is opened, it moves linearly forward as shown in FIG. 3.

Link plates 46 have substantially rectangular long and thin plate shapes, and four link plates 46 are provided corresponding to the drum side press levers 40. One end portion of the link plate 46 is fixed so as to swing between the upper end portion and the middle portion of the drum side press lever 40. The other end portion of the link plate 46 is fixed to the translation cam 45 forward of one end portion of the link plate 46 so as to swing.

In the positioning mechanism 37, as shown in FIG. 3, when the top cover 34 is opened, the translation cam 45 is moved forward, and accordingly, the link plates 46 pull the drum side press levers 40 forward, and the drum side press levers 40 are swung clockwise so as to withdraw from the guide grooves 36 around the swing shafts 44 as fulcrums. Then, the protrusions 42 move forward so as to separate from the drum side input couplings 18.

As shown in FIG. 4, when the top cover 34 is closed, the translation cam 45 is moved backward, and accordingly, the link plate 46 moves backward, so that the drum side press levers 40 are swung counterclockwise so as to advance into the guide grooves 36 around swing shafts 44 as fulcrums by pulling forces of tension springs 43. Then, the protrusions 42 move backward so as to press the drum side input couplings 18 to the lower back side.

The protrusions 42 press the drum side input couplings 18 to the lower back side, so that the lower sides and back sides of the drum side input couplings 18 come into contact with two positioning portions 39, and accordingly, the process cartridges 12 are positioned in the body casing 2.

(3) Separation Mechanism

Figure 6:
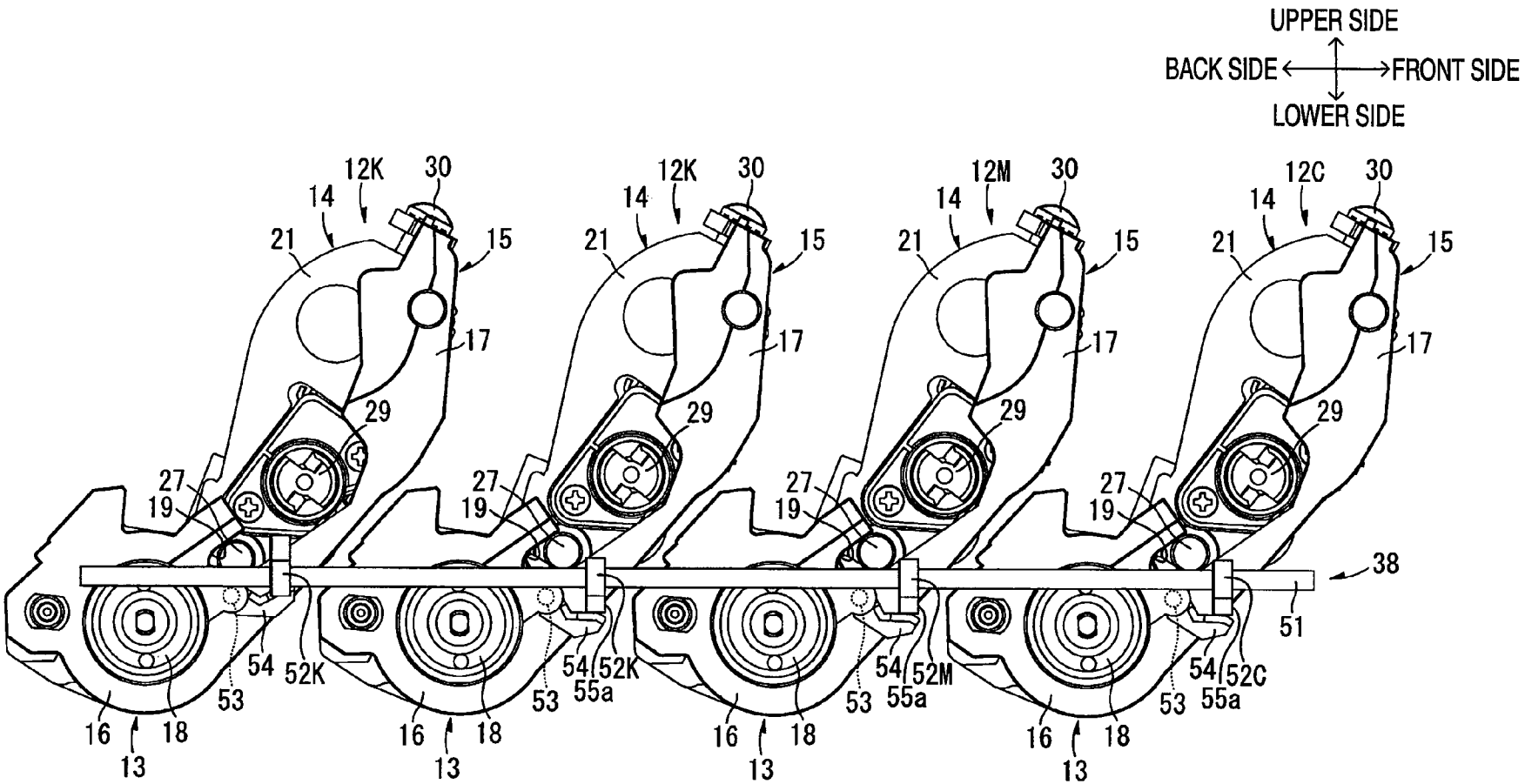
FIG. 6 is a schematic perspective view of the body casing of FIG. 2 in a monochrome mode as viewed from the left side.

The separation mechanism 38 includes, as shown in FIG. 2 and FIG. 6, a rotation shaft 51 and developing side press levers 52 together as an example of a second pressing member, support shafts 53, and swing levers 54. The developing side press levers 52 are an example of press levers.

One rotation shaft 51 is provided so as to extend along the front-back direction across the four guide grooves 36. The rotation shaft 51 is supported on the body casing 2 rotatably so as to be arranged and opposed to the four guide grooves 36 on the left sides of the guide grooves 36.

To the rotation shaft 51, a stepping motor (not shown) provided in the body casing 2 is connected. The rotation shaft 51 is rotated clockwise in a front view (front face view) by a driving force of the stepping motor.

Four developing side press levers 52 are provided and correspond to the four process cartridges 12. Each developing side press lever 52 is arranged on the front side of each guide groove 36 in a side view and supported on the rotation shaft 51.

The developing side press lever 52 has a substantially trapezoid plane shape extending so as to gradually increase in width along the radial direction. The developing side press lever 52 includes a free end portion and a base end portion. At the free end portion of the developing side press lever 52, a contact portion 55 is provided. The contact portion 55 is provided so as to project along the radial direction from the developing side press lever 52 (see FIG. 2).

One contact portion 55 is provided for the developing side press lever 52 corresponding to the process cartridge 12K for black (hereinafter, referred to as black side press lever 52K) (see the enlarged view of FIG. 2).

In addition, two contact portions 55 are provided adjacent to each other in the circumferential direction of the rotation shaft 51 for the developing side press levers 52 corresponding to the process cartridges 12Y, 12M, and 12C for the three colors other than black (in detail, the developing side press lever 52Y (yellow) corresponding to the process cartridge 12Y, the developing side press lever 52M (magenta) corresponding to the process cartridge 12M, and the developing side press lever 52C (cyan) corresponding to the process cartridge 12C, and the non-black levers are collectively referred to as three-color side press levers 52YMC) (hereinafter, of the two contact portions 55 provided for the three-color side press levers 52YMC, the contact portion 55 on the upstream side in the rotating direction of the rotation shaft 51 will be referred to as an upstream side contact portion 55*a*, and the contact portion 55 on the downstream side in the rotating direction of the rotation shaft 51 will be referred to as a lower side contact portion 55*b*) (see the enlarged view of FIG. 2).

The three-color side press levers 52YMC are supported on the rotation shaft 51 at a rotation angle so that when they are projected in the front-back direction (axial direction of the rotation shaft 51), all upstream side contact portions 55*a* overlap each other and all downstream side contact portions 55*b* overlap each other.

The black side press lever 52K is supported on the rotation shaft 51 at a rotation angle at which the contact portion 55 of the black side press lever 52K overlaps the downstream side contact portions 55*b* of the three-color side press levers 52YMC when the black side press lever 52K is projected with respect to the three-color side press levers 52YMC in the front-back direction (axial direction of the rotation shaft 51).

For the four process cartridges 12, four support shafts 53 are correspondingly provided (see FIG. 6). Each support shaft 53 is provided on the side plate 35 so that the support shaft 53 is arranged below the roller shaft 27 when the process cartridge 12 is mounted to the body casing 2. The support shafts 53 are provided so as to project leftward from the side plate 35.

For the four process cartridges 12, four swing levers 54 are correspondingly provided. Each swing lever 54 has a substantially V-shaped plane shape in a side view. The swing lever 54 is supported on the support shaft 53 so as to swing at the middle in the longitudinal direction. The back end portion (one longitudinal side end portion) of the swing lever 54 is arranged and opposed to the roller shaft 27 below the roller shaft 27 so as to come into contact with the roller shaft 27. The front end portion (the other longitudinal side end portion) of the swing lever 54 swells leftward so as to be pressed by the contact portion 55 of the developing side press lever 52, and is arranged so that the front end portion faces the inside of the circumferential movement locus of the contact portion 55 and is contacted by the contact portion 55 from above.

In the separation mechanism 38, when the rotation shaft 51 is rotated by the driving force of the stepping motor (not shown), the developing side press levers 52 are rotated so that the free end portions move circumferentially. Then, the contact portions 55 provided on the developing side press levers 52 come into contact with and press the front end portions of the swing levers 54 in acting directions as an example of a second direction downward from the upper side. The swing levers 54 swing clockwise in a left side view around the support shafts 53 as fulcrums, and the back end portions of the swing levers 54 come into contact with and press the roller shafts 27 to the upper front side from below. In other words, the back end portions of the swing levers 54 lift the roller shafts 27 to the upper front side along the shaft guide grooves 19. Then, the developing cartridges 14 are lifted to the upper front side against the pressing forces of the pressed portions 30, and the developing rollers 6 and the photosensitive drums 3 separate from each other.

Thereafter, when the rotation shaft 51 further rotates and the contacts of the contact portions 55 provided on the developing side press levers 52 with the front end portions of the swing levers 54 are released, the pressing forces on the roller shafts 27 by the back end portions of the swing levers 54 are released, so that the developing cartridges 14 are pressed to the lower back side by the pressing pressures of the pressed portions 30. Then, the roller shafts 27 move to the lower back side along the shaft guide grooves 19, and the swing levers 54 are pressed to the lower back side by the roller shafts 27 and swung counterclockwise in a left side view around the support shafts 53 as fulcrums. Then, the developing rollers 6 and the photosensitive drums 3 come into contact with each other. The developing cartridges 14 are pressed from the pressed portions 30, so that the developing rollers 6 are brought into pressure contact with the photosensitive drums 3.

(Operation of Image Forming Apparatus)

(1) Mounting a Process Unit

As described above, as shown in FIG. 3, the top cover 34 is opened and the drum side input couplings 18 are inserted into the guide grooves 36 from the upper side of the body casing 2 and moved to the lower back side along the guide grooves 36, whereby the process cartridges 12 are mounted to the body casing 2.

Thereafter, as shown in FIG. 4, when the top cover 34 is closed, the developing cartridges 14 are pressed downward by reactive forces of the pressed portions 30, and normally, the developing rollers 6 and the photosensitive drums 3 are brought into pressure contact with each other.

In conjunction with closing of the top cover 34, the translation cam 45 is moved backward, so that the drum side press levers 40 are swung around the swing shafts 44 as fulcrums by the pulling forces of the tension springs 43 and the protrusions 42 press the drum side input couplings 18 to the lower back side. Accordingly, the drum side input couplings 18 come into contact with the two positioning portions 39 on the lower sides and the back sides, and the process cartridges 12 are positioned with respect to the body casing 2.

(2) Image Forming Operation

In the image forming apparatus 1, switching is performed among a full-color mode in which each of the photosensitive drums 3K, 3Y, 3M, and 3C is brought into pressure contact with its corresponding developing roller 6 when forming an image, a monochrome mode in which only the black photosensitive drum 3K is brought into contact with its corresponding developing roller 6 when forming an image, and a standby mode in which each of the photosensitive drums 3 is separated from its corresponding developing roller 6 at a time when no image is being formed, as appropriate.

In detail, in the image forming apparatus 1, the full-color mode, the monochrome mode, and the standby mode are automatically switched by controlling the stepping motor (not shown) by a CPU (not shown) provided in the body casing 2.

The standby mode and the full-color and monochrome modes are selectively switched based on whether an image is being formed. In contrast, the full-color mode and the monochrome mode are selectively switched by the CPU (not shown) in response to an instruction included in image data or an input from an operation panel (not shown).

In the full-color mode, as shown in FIG. 2 and FIG. 4, the rotation shaft 51 is rotated by the stepping motor, and the rotation shaft 51 is positioned at a rotation angle corresponding to an all-separated position at which the contact portion 55 of each of the developing side press levers 52 is separated from its corresponding swing lever 54.

Then, the contact of the contact portion 55 of each of the developing side press levers 52 with respect to its corresponding swing lever 54 is released, so that, as described above, the developing cartridges 14 are pressed to the lower back side by the pressing forces of the pressed portions 30, and all of the photosensitive drums 3 are brought into pressure contact with their corresponding developing rollers 6.

Accordingly, when forming an image in the full-color mode, developer images are formed on each of the photosensitive drums 3K, 3Y, 3M, and 3C, and by superimposing the four colors, a full-color image is formed on the sheet P.

Figure 5:
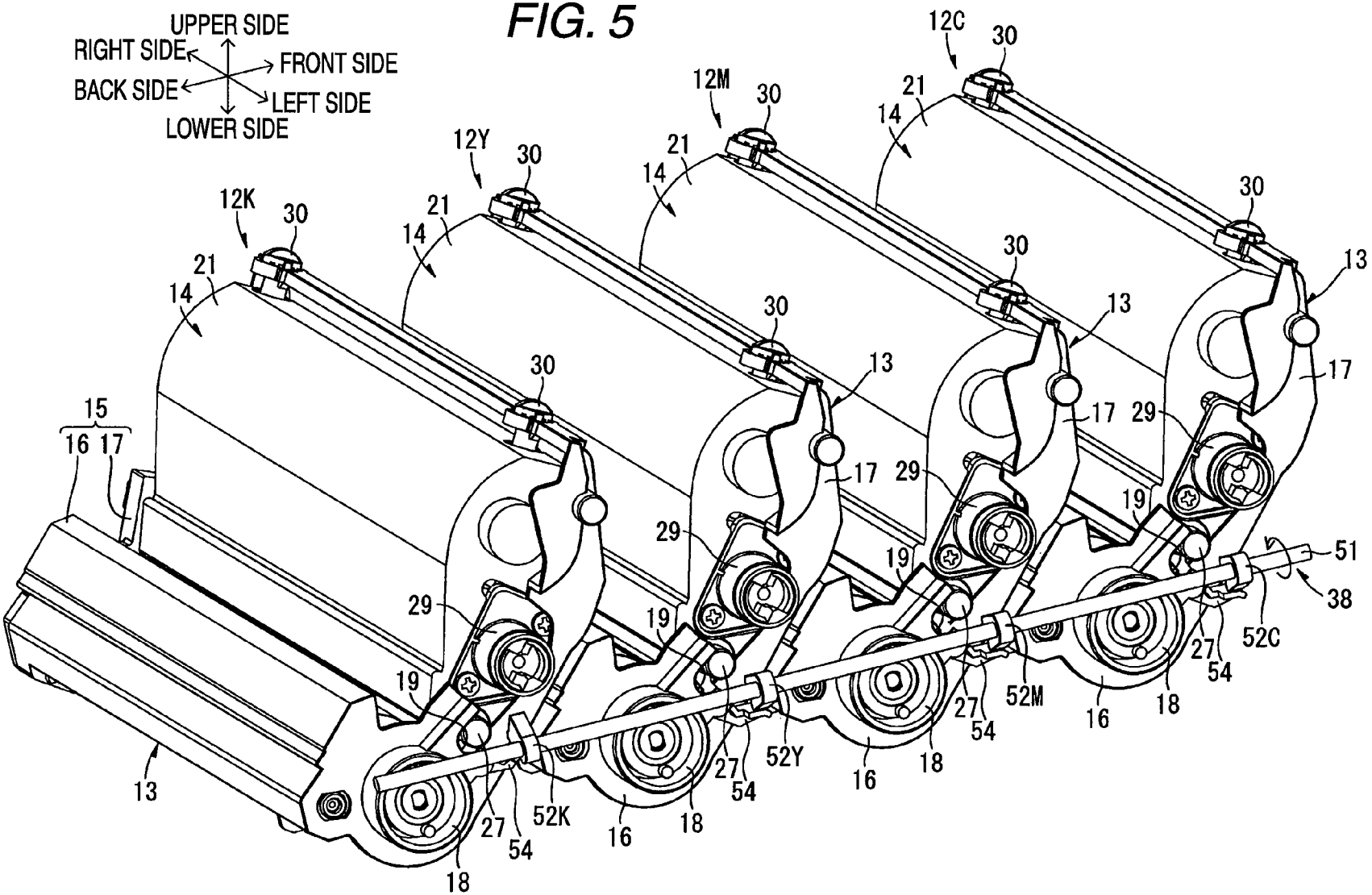
FIG. 5 is a schematic perspective view of the body casing of FIG. 2 in a monochrome mode as viewed from the back-left side.

In the monochrome mode, as shown in FIG. 5 and FIG. 6, the rotation shaft 51 is rotated by the stepping motor and the rotation shaft 51 is positioned at a rotation angle of the black separated position as an example of a partial contact position at which the upstream side contact portions 55*a* of the three-color side press levers 52YMC press corresponding swing levers 54 downward and the contact portion 55 of the black side press lever 52K is separated from the corresponding swing lever 54.

Then, the upstream side contact portions 55*a* of the three-color side press levers 52YMC press the corresponding swing levers 54 downward, so that as described above, the swing levers 54 lift the roller shafts 27 to the upper front side. Then, the developing cartridges 14 other than the black developing cartridge 14 are lifted to the upper front side against the pressing forces of the pressed portions 30, and the developing rollers 6 and the photosensitive drums 3Y, 3M, and 3C for the three colors other than black are separated from each other.

In contrast, the contact of the contact portion 55 of the black side press lever 52K with respect to the swing lever 54 is released, so that as described above, the developing cartridge 14 for black is pressed to the lower back side by the pressing force of the pressed portion 30, and with respect to the photosensitive drum 3K for black, the corresponding developing roller 6 is brought into pressure contact.

Accordingly, when forming an image in the monochrome mode, a developer image is formed on only the photosensitive drum 3K for black, so that a monochrome image is formed on the sheet P.

Figure 7:
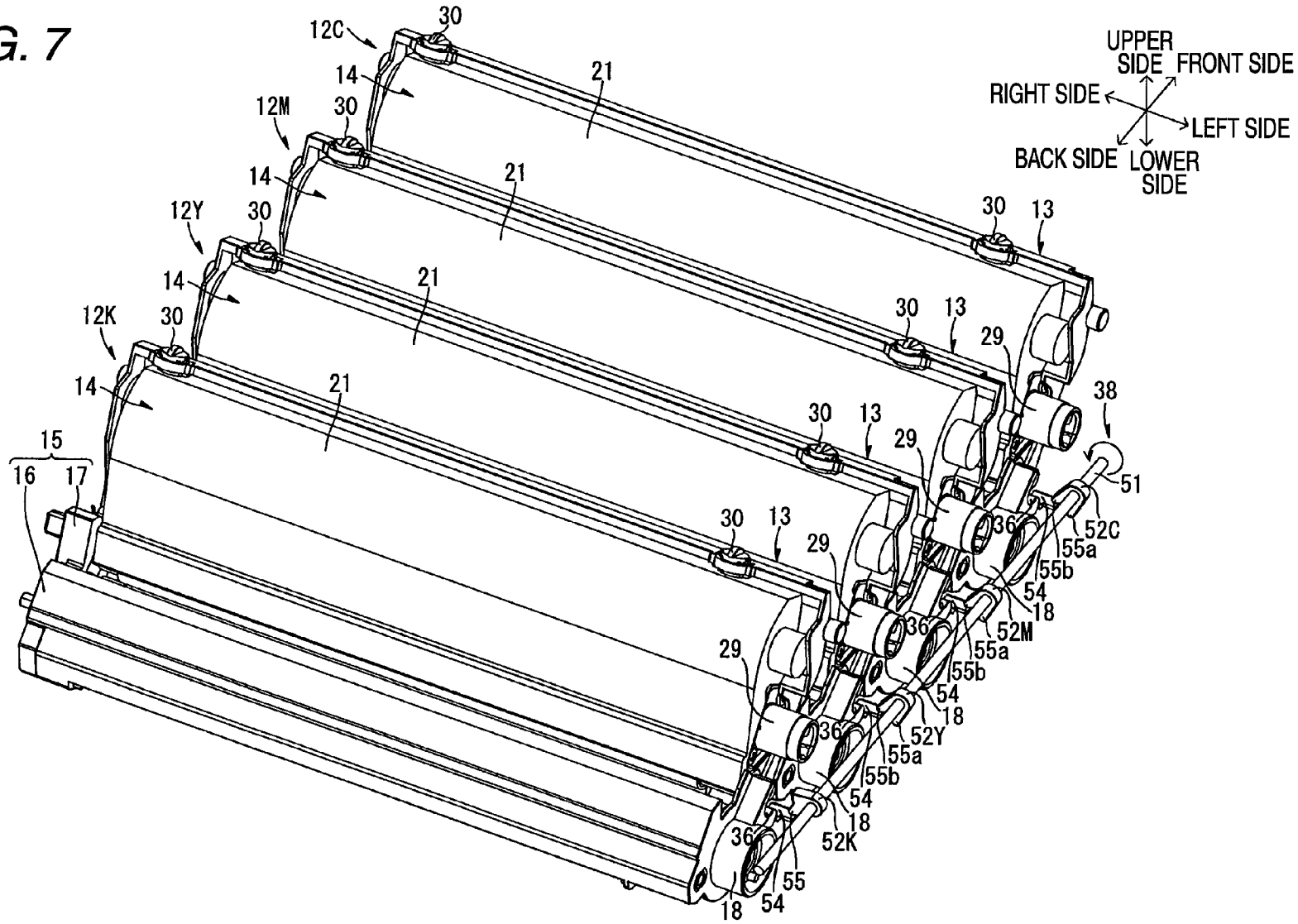
FIG. 7 is a schematic perspective view of the body casing of FIG. 2 in a standby mode as viewed from the back-left side.
Figure 8:
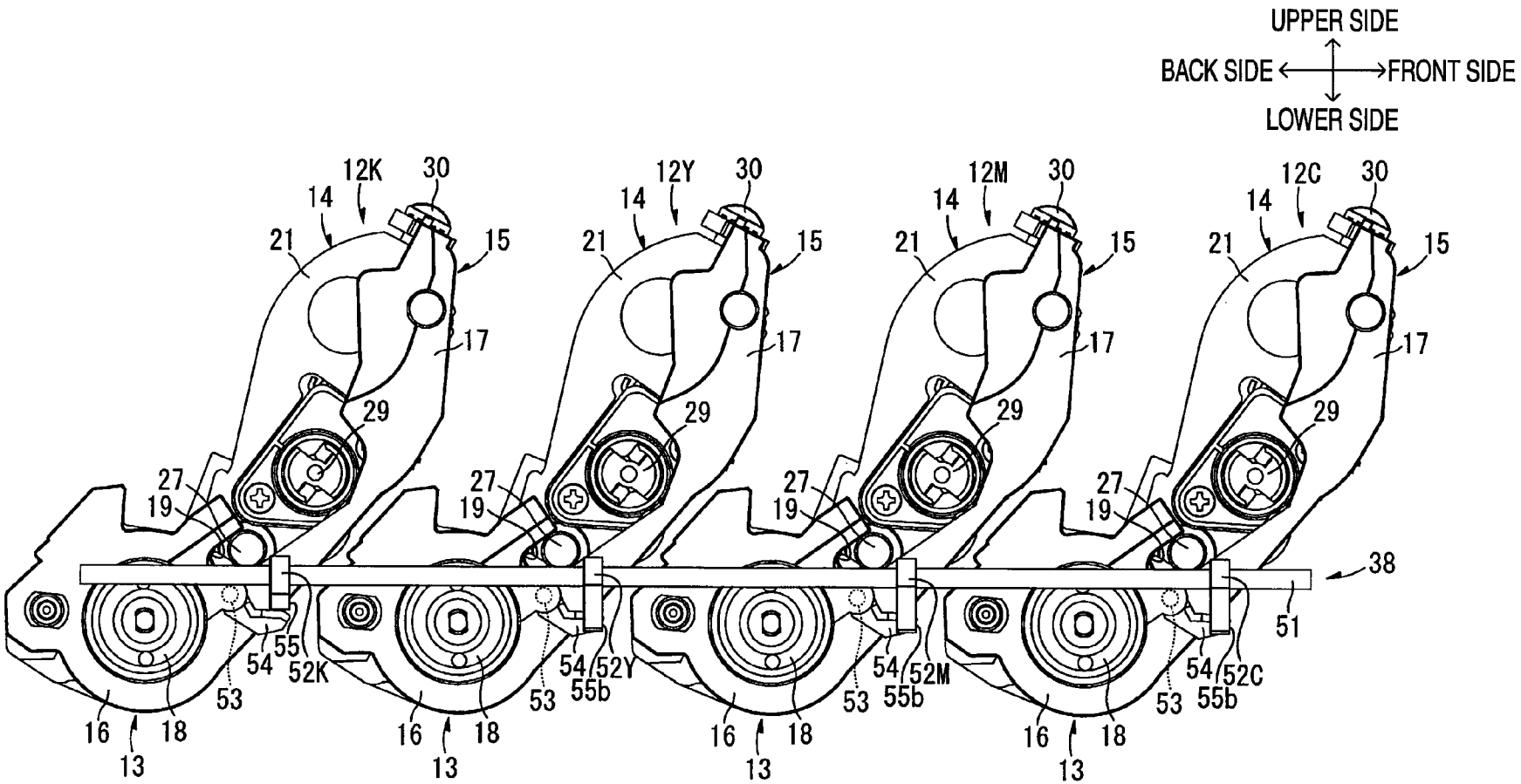
FIG. 8 is a left side view of the body casing of FIG. 7 in the standby mode.

In the standby mode, as shown in FIG. 7 and FIG. 8, the rotation shaft 51 is rotated by the stepping motor and the rotation shaft 51 is positioned at a rotation angle of the all contact position at which the downstream side contact portions 55*b* of the three-color side press levers 52YMC press the corresponding swing levers 54 downward, and the contact portion 55 of the black side press lever 52K presses the corresponding swing lever 54 downward.

Then, the downstream contact portions 55*b* of the three-color side press levers 52YMC and the contact portion 55 of the black side press lever 52K press all corresponding swing levers 54 downward, so that as described above, the swing levers 54 lift all of the roller shafts 27 to the upper front side. Then, all of the developing cartridges 14 are lifted to the upper front side against the pressing forces of the pressed portions 30, and the developing rollers 6 and all photosensitive drums 3K, 3Y, 3M, and 3C separate from each other.

Accordingly, when an image is not being formed, all photosensitive drums 3K, 3Y, 3M, and 3C are separated from their corresponding developing rollers 6.

Then, a rotation angle of the rotation shaft 51 is controlled by the stepping motor such that the rotation shaft 51 is rotated by 360 degrees clockwise when viewed from a front view (front face view) so as to be sequentially positioned at the all-separated position, the black separated position, and the all contact position.

During a 360-degree rotation of the rotation shaft 51, the three-color side press levers 52YMC come into contact with the swing levers 54 twice. In other words, the upstream side contact portions 55*a* come into contact with the swing levers 54 at the black separated position, and the downstream side contact portions 55*b* come into contact with the swing levers 54 at the all contact position.

In contrast, during the 360-degree rotation of the rotation shaft 51, the black side press lever 52K comes into contact with its corresponding swing lever 54 once. In other words, the contact portion 55 of the black side press lever 52K comes into contact with the swing lever 54 at the all contact position.

(3) Removal of a Process Unit

When an image is not being formed, as described above, the rotation shaft 51 is positioned at the all-separated position, and all the photosensitive drums 3K, 3Y, 3M, and 3C are separated from their corresponding developing rollers 6, so that as shown in FIG. 3, by opening the top cover 34 and in conjunction with opening of the top cover 34, the translation cam 45 is moved forward. Accordingly, the link plates 46 pull the drum side press levers 40 forward, the drum side press levers 40 are swung around the swing shafts 44 as fulcrums against the pulling forces of the tension springs 43, and the protrusions 42 separate from the drum side input couplings 18.

Thereafter, by pulling the process cartridges 12 out to the upper front side along the guide grooves 36, the process cartridges 12 are removed from the body casing 2.

In the image forming apparatus 1, when positioning the process cartridges 12 with respect to the body casing 2, the protrusions 42 of the drum side press levers 40 press the drum side input couplings 18 to the lower back side and bring the drum side input couplings 18 into contact with the two positioning portions 39 on the lower sides and back sides.

In contrast, to separate the developing rollers 6 from the photosensitive drums 3, the rotation shaft 51 is rotated by the stepping motor, and the swing levers 54 are pressed downward by the contact portions 55 of the developing side press levers 52. Then, the swing levers 54 lift the roller shafts 27 to the upper front side and the developing rollers 6 separate from the photosensitive drums 3.

Then, in the image forming apparatus 1, with respect to the positioning portions 39, the positioning direction in which the drum side press levers 40 press the drum side input couplings 18 to the lower back side and the acting direction in which the contact portions 55 of the developing side press levers 52 press the swing levers 54 downward are the same downward direction.

Therefore, even when the developing rollers 6 are separated from the photosensitive drums 3 after positioning the process cartridges 12 in the body casing 2, the positioning direction and the acting direction are substantially the same direction, so that positional deviation of the process cartridges 12 with respect to the body casing 2 and vibration can be suppressed. As a result, deterioration of image forming accuracy can be prevented, and the correction time when forming an image can be shortened.

In the separation mechanism 38, by pressing the contact portions 55 of the developing side press levers 52, the swing levers 54 swing, and by pressing the roller shafts 27 by the back end portions of the swing levers 54, the developing cartridges 14 are moved in a direction in which the developing rollers 6 separate from the photosensitive drums 3. Therefore, by swinging the swing levers 54, the developing rollers 6 can be easily and reliably separated from the photosensitive drums 3.

In the separation mechanism 38, by rotating the developing side pressing levers 52 around the rotation shaft 51 as a fulcrum, the contact portions 55 press the swing levers 54. Therefore, by swinging the swing levers 54, the developing rollers 6 can be easily and reliably separated from the photosensitive drums 3. The rotation shaft 51 extends along the front-back direction orthogonal to the axial directions of the support shafts 53, so that downsizing in the axial directions (that is, the width directions) of the support shafts 53 can be realized.

In the separation mechanism 38, by rotating one rotation shaft 51, the developing side press levers 52 corresponding to the four developing cartridges 14 rotate, and corresponding swing levers 54 are pressed. Then, due to swinging of the swing levers 54, corresponding roller shafts 27 are pressed and the developing cartridges 14 are moved in a direction in which the developing rollers 6 separate from the photosensitive drums 3. Therefore, by rotating one rotation shaft 51, all developing cartridges 14 can be moved in the direction in which the developing rollers 6 separate from the photosensitive drums 3.

Further, in the separation mechanism 38, by sequentially changing the rotation angle of the rotation shaft 51 using the stepping motor, at the all contact position, the downstream side contact portions 55*b* of the three-color side press levers 52YMC and the contact portion 55 of the black side press lever 52K press all corresponding swing levers 54 downward. Therefore, the corresponding developing rollers 6 can be separated from all photosensitive drums 3K, 3Y, 3M, and 3C.

Further, at the monochrome position, the upstream side contact portions 55*a* of the three-color side press levers 52YMC press the corresponding swing levers 54 downward, and in contrast, the contact of the contact portion 55 of the black side press lever 52K with respect to the swing lever 54 is released. Therefore, with respect to only the photosensitive drum 3K for black, the corresponding developing roller 6 can be brought into pressure contact.

At the all-contact position, the contact portions 55 of all developing side press levers 52 separate from the corresponding swing levers 54. Therefore, with respect to all photosensitive drums 3, the corresponding developing rollers 6 can be brought into pressure contact.

As a result, by a simple structure in which the rotation shaft 51 is rotated, the separation modes of the developing rollers 6 with respect to the photosensitive drums 3, that is, the standby mode, the monochrome mode, and the full-color mode can be switched.

In the black side press lever 52K, during a 360-degree rotation of the rotation shaft 51, the contact portion 55 is brought into contact with the swing lever 54 once, and in the three-color side press levers 52YMC, during a 360-degree rotation of the rotation shaft 51, the upstream side contact portions 55*a* and the downstream side contact portions 55*b* are brought into contact with the swing levers 54 once each, that is, twice. Therefore, the separation modes can be switched by a simple structure.

In other words, on the black side press lever 52K, one contact portion 55 is provided, and on the three-color side press levers 52YMC, two contact portions 55 including the upstream side contact portion 55*a* and the downstream side contact portion 55*b* are provided, so that by a simple structure in which the number of contact portions 55 is changed according to the number of contacts, the separation modes can be switched by a simple structure.

(Another Exemplary Embodiment)

In the above-described first exemplary embodiment, the rotation shaft 51 and the developing side press levers 52 are provided in the separation mechanism 38. Alternatively, as shown in FIG. 9, in a second exemplary embodiment, a slide plate 61 may be provided as an example of a second pressing member.

In the second exemplary embodiment described below, the structure is the same as in the above-described exemplary embodiment except that the slide plate 61 is provided instead of the rotation shaft 51 and the developing side press levers 52. In fact, the above-described positioning mechanism 37, etc., are also provided in the second exemplary embodiment. In the following description of FIGS. 9-14, the same members as described above are attached with the same reference numerals, and description thereof is omitted.

(1) Separation Mechanism

Figure 9:
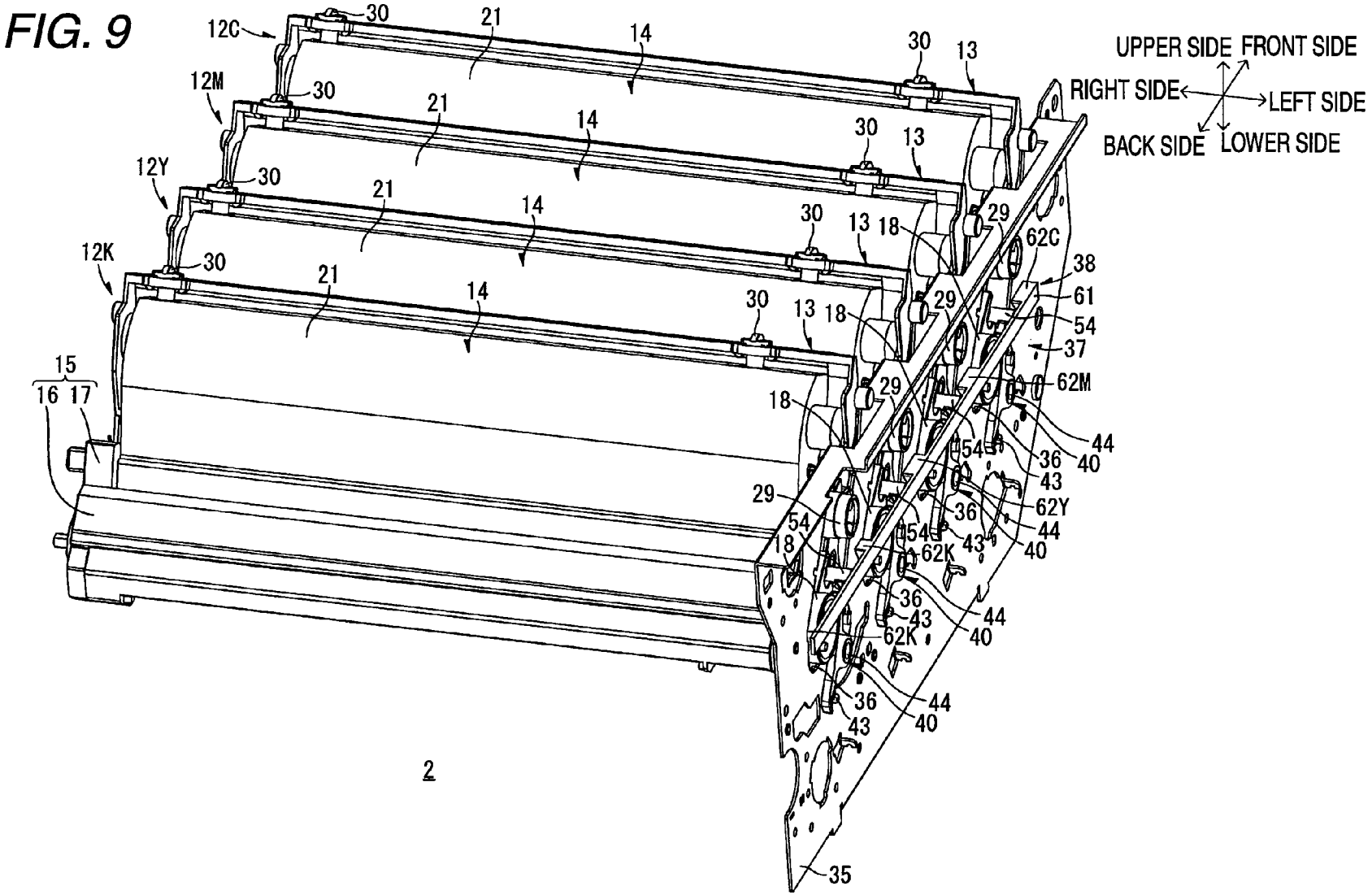
FIG. 9 is a schematic perspective view of the body casing of FIG. 2 in the full-color mode according to another exemplary embodiment of the invention as viewed from the back-left side.

The separation mechanism 38 includes, as shown in FIG. 9, a slide plate 61, the support shafts 53 and the swing levers 54.

The slide plate 61 has a long and thin rectangular shape which is a plane in the up-down direction. The slide plate 61 is provided so as to extend along the front-back direction across the four guide grooves 36. The slide plate 61 is supported slidably on the body casing 2 so as to be arranged and opposed to the four guide grooves 36 on the left sides of the guide grooves 36.

To the slide plate 61, a stepping motor (not shown) provided in the body casing 2 is connected. The stepping motor slides the slide plate 61 in the front-back direction by a driving force of the stepping motor.

The slide plate 61 is provided with pressing portions 62 corresponding to the four process cartridges 12. The pressing portions 62 are arranged in front of the guide grooves 36 in the full-color mode.

Figure 12:
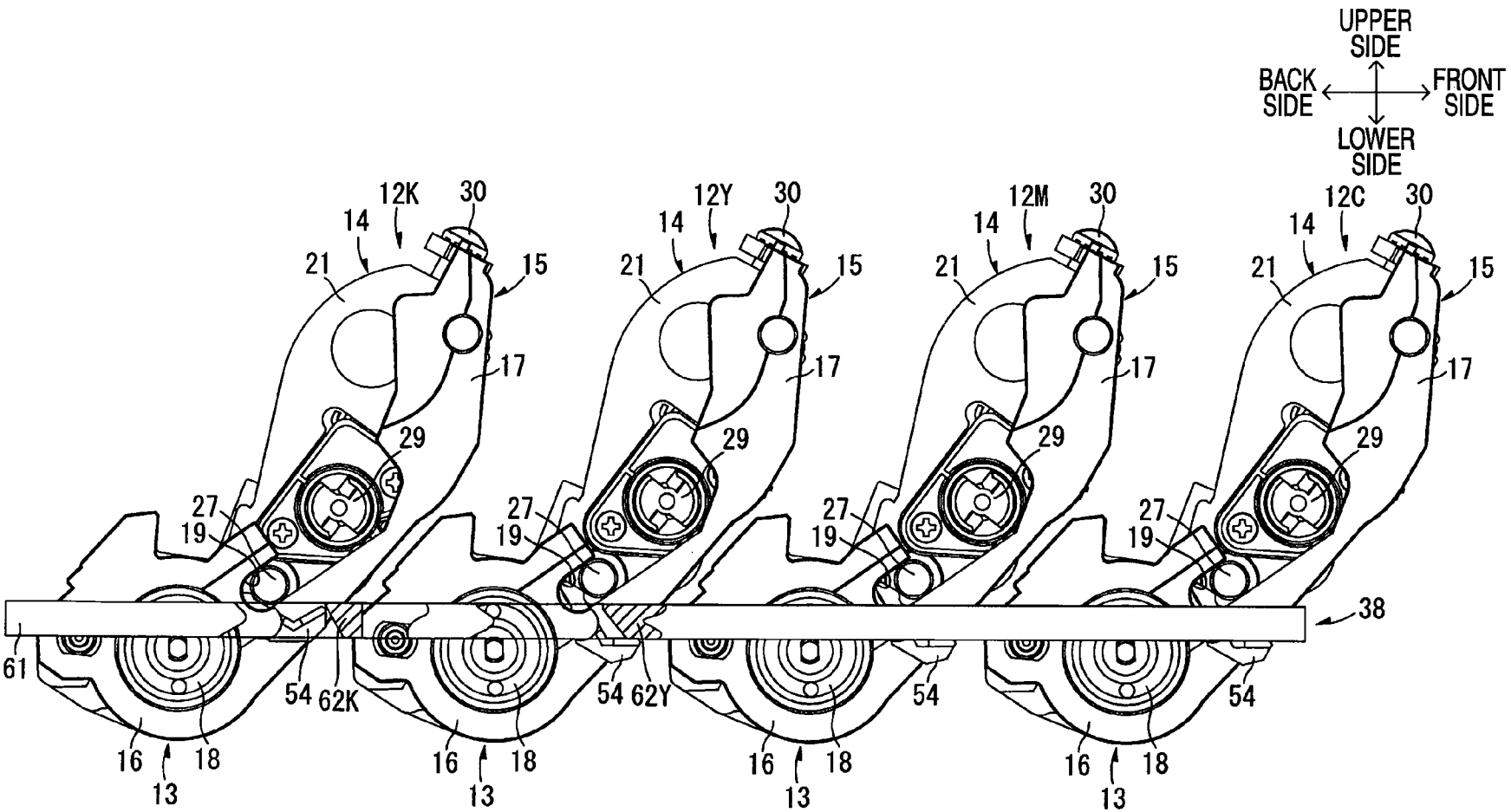
FIG. 12 is a left side view of the body casing of FIG. 9 in the monochrome mode.

The pressing portion 62 has a substantially rectangular block shape swelling rightward from the slide plate 61, and is provided integrally with the slide plate 61. The back end face of the pressing portion 62 is formed as an inclined surface from the lower front end to the upper back end as shown in FIG. 12.

The lower end face of the pressing portion 62 corresponding to the process cartridge 12K for black (hereinafter, referred to as a black side pressing portion 62K) is formed to be shorter in the front-back direction than the lower end faces of the pressing portions 62 corresponding to the process cartridges 12Y, 12M, and 12C for three colors other than black (in detail, the pressing portion 62Y corresponding to the process cartridge 12Y (yellow), the pressing portion 62M corresponding to the process cartridge 12M (magenta), and the pressing portion 62C corresponding to the process cartridge 12C (cyan), hereinafter, these are collectively referred to as three-color side pressing portions 62YMC).

In detail, the lower end face of the black side pressing portion 62K is formed so as to have a length which presses the swing lever 54 only in the standby mode. The three-color side pressing portions 62YMC are formed so as to have lengths which press the swing levers 54 in both the monochrome mode and the standby mode.

In the separation mechanism 38, when the slide plate 61 slides backward due to a driving force of the stepping motor (not shown), the back end face of the pressing portion 62 comes into contact with the front end portion of the swing lever 54, and along the inclination angle of the back end face of the pressing portion 62, in an acting direction as an example of a second direction in which the front end portion of the swing lever 54 moves downward from the upper side, the pressing portion 62 hits the front end portion of the swing lever 54, and the lower end face of the pressing portion 62 presses the front end portion of the swing lever 54.

Then, the swing levers 54 swing clockwise in a left view around the support shafts 53 as fulcrums, and the backend portions of the swing levers 54 come into contact with and press the roller shafts 27 to the upper front side from below. In other words, the back end portions of the swing levers 54 lift the roller shafts 27 to the upper front side along the shaft guide grooves 19. Then, the developing cartridges 14 are lifted to the upper front side against the pressing forces of the pressed portions 30, and the developing rollers 6 and the photosensitive drums 3 separate from each other.

Figure 10:
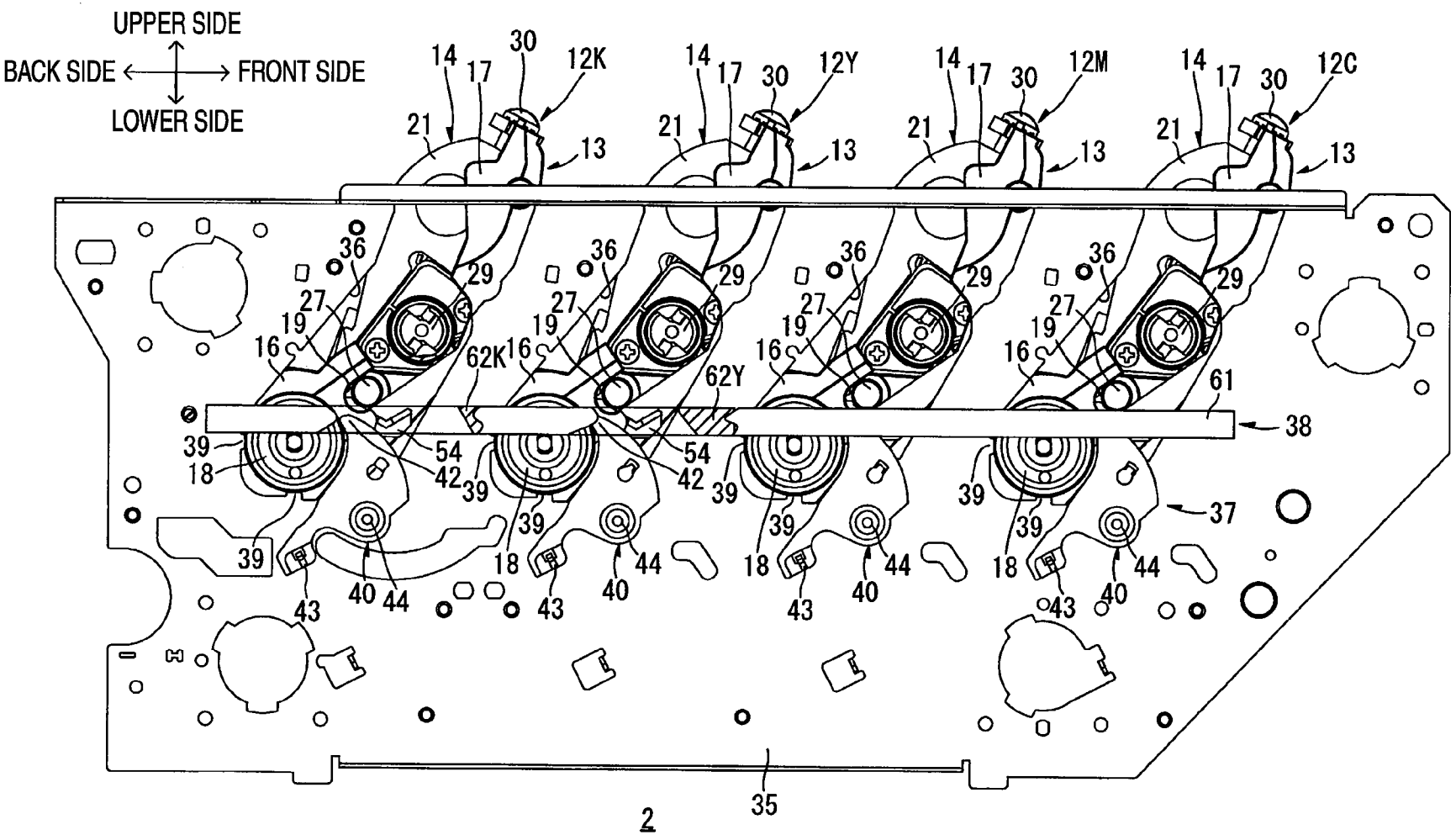
FIG. 10 is a left side view of the body casing of FIG. 9 in the full-color mode.

Thereafter, by the driving force of the stepping motor (not shown), when the slide plate 61 slides forward, as shown in FIG. 10, the pressing portions 62 separate from the swing levers 54. Then, the pressing forces on the roller shafts 27 from the back end portions of the swing levers 54 are released, so that the developing cartridges 14 are pressed to the lower back side by the pressing forces of the pressed portions 30. Then, the roller shafts 27 move to the lower back side along the shaft guide grooves 19, and the swing levers 54 are pressed to the lower back side by the roller shafts 27 and swung counterclockwise in a left view around the support shafts 53 as fulcrums.

Then, the developing rollers 6 and the photosensitive drums 3 come into contact with each other. The developing cartridges 14 are pressed by the pressed portions 30, so that the developing rollers 6 are brought into pressure contact with the photosensitive drums 3.

(2) Image Forming Operation

Then, in the second exemplary embodiment, the full-color mode, the monochrome mode, and the standby mode are switched as follows.

That is, in the full-color mode, as shown in FIG. 9 and FIG. 10, the slide plate 61 is slid forward by the stepping motor and all pressing portions 62 are positioned at the all-separated position (forefront position) at which all pressing portions 62 separate from corresponding swing levers 54.

When the slide plate 61 is in the forward position, the contacts of all pressing portions 62 with respect to the swing levers 54 are released, so that as described above, the developing cartridges 14 are pressed to the lower back side by the pressing forces of the pressed portions 30, and with respect to all photosensitive drums 3, the corresponding developing rollers 6 are brought into pressure contact.

Accordingly, when forming an image in the full-color mode, developer images are formed on all photosensitive drums 3K, 3Y, 3M, and 3C, and on the sheet P, a full-color image is formed by superimposing four colors.

Figure 11:
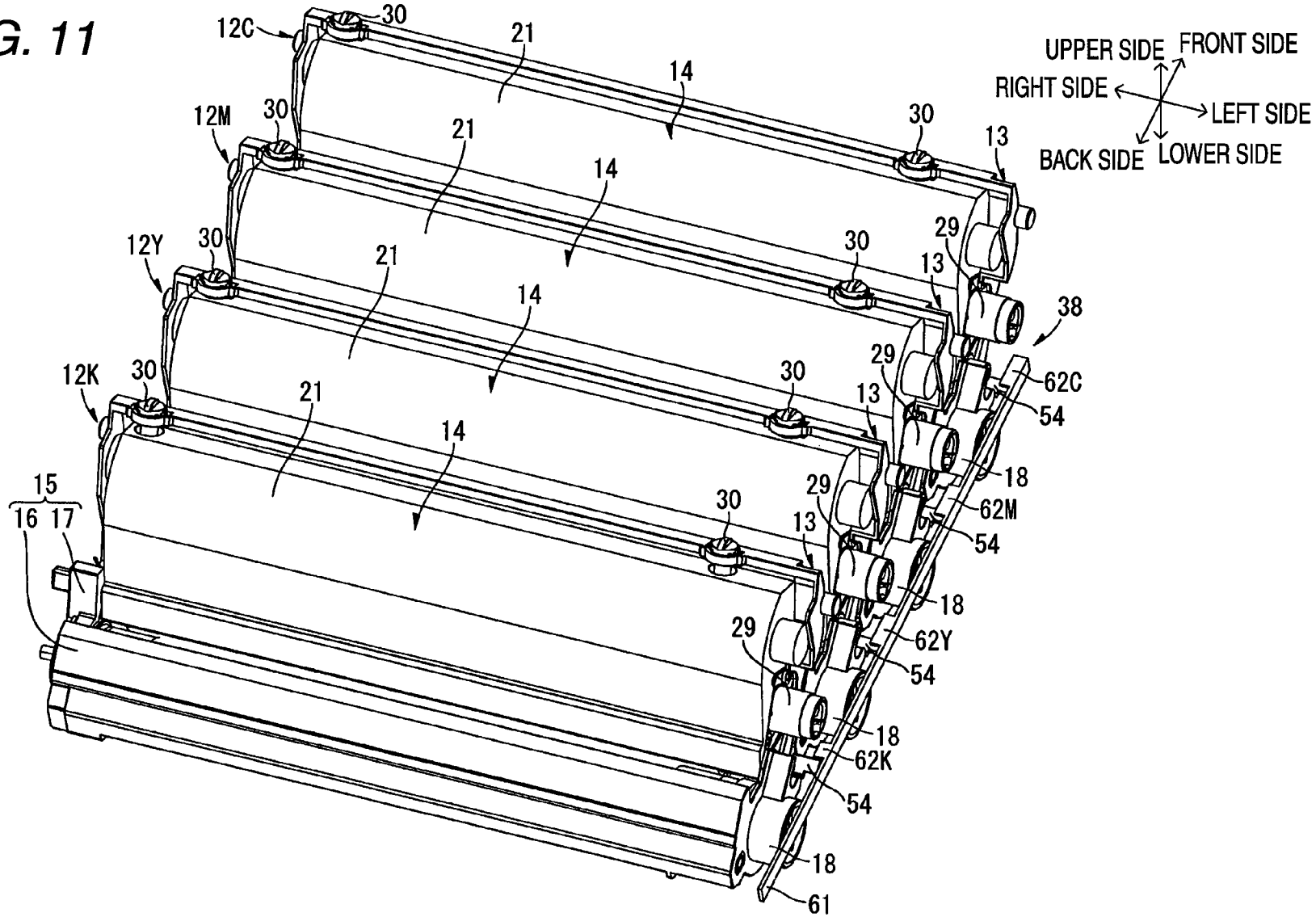
FIG. 11 is a schematic perspective view of the body casing of FIG. 9 in a monochrome mode as viewed from the back-left side.

In the monochrome mode, as shown in FIG. 11 and FIG. 12, the slide plate 61 is slid backward by the stepping motor and the three-color side pressing portions 62YMC press down on their corresponding swing levers 54 so that the slide plate 61 is positioned at the black separated position (intermediate position) as an example of a partial contact position at which the black side pressing portion 62K is separated from the corresponding swing lever 54 and only the photosensitive drum 3K is in contact with its corresponding developing roller 6.

When the slide plate 61 is in the intermediate position, the three-color side pressing portions 62YMC press the corresponding swing levers 54 downward, so that as described above, the swing levers 54 lift the roller shafts 27 to the upper front side. Then, the developing cartridges 14 other than the developing cartridge 14 for black are lifted to the upper front side against the pressing forces of the pressed portions 30, and the photosensitive drums 3Y, 3M, and 3C for three colors other than black are separated from their corresponding developing rollers 6.

In contrast, the contact of the black side pressing portion 62K with respect to the swing lever 54 is released, so that as described above, the developing cartridge 14 for black is pressed to the lower back side by the pressing force of the pressed portion 30, and with respect to the photosensitive drum 3K for black, the corresponding developing roller 6 is brought into pressure contact.

Accordingly, when forming an image in the monochrome mode, a developer image is formed on only the photosensitive drum 3K for black, so that a monochrome image is formed on the sheet P.

Figure 13:
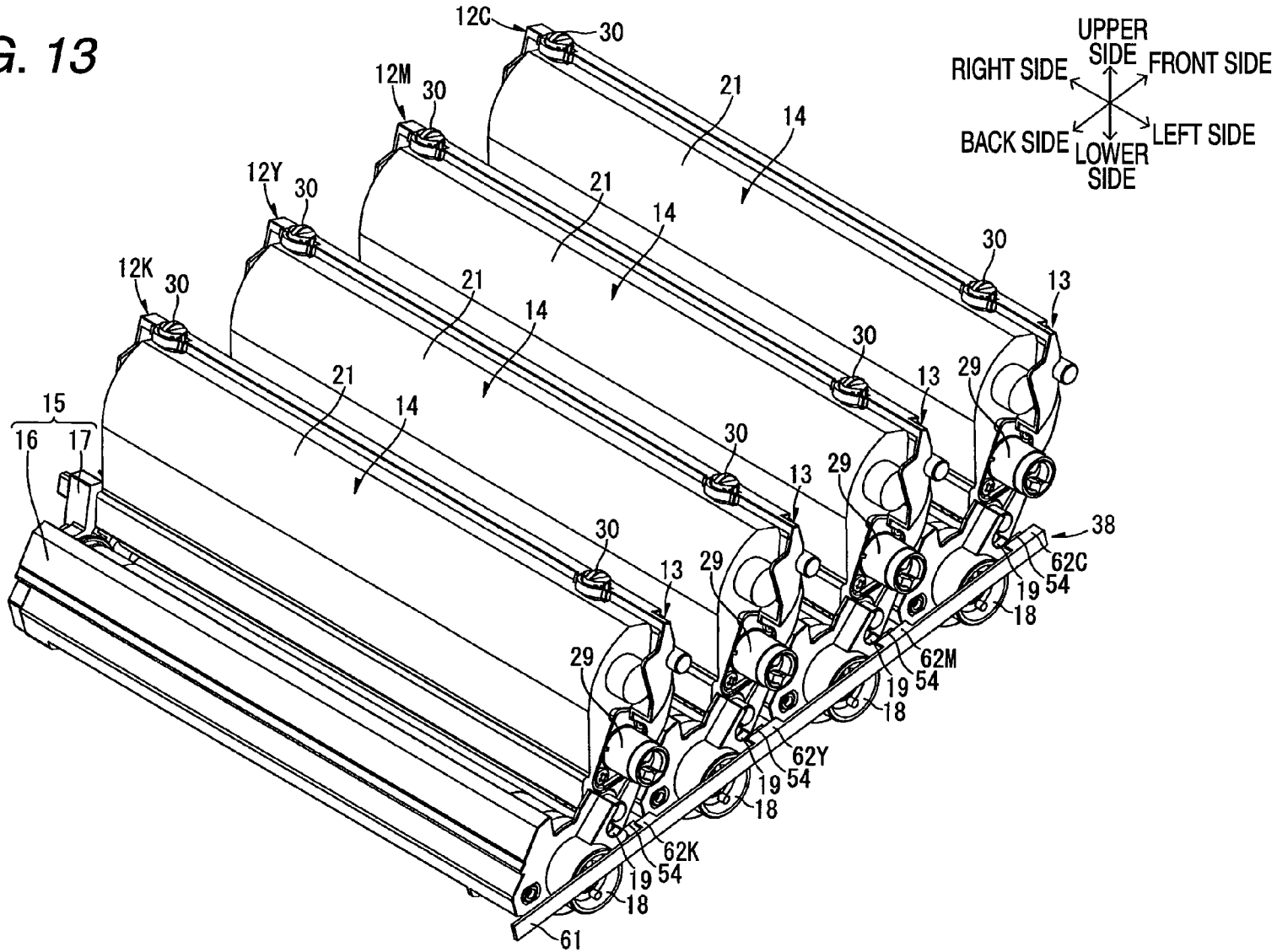
FIG. 13 is a schematic perspective view of the body casing of FIG. 9 in a standby mode as viewed from the back-left side.
Figure 14:
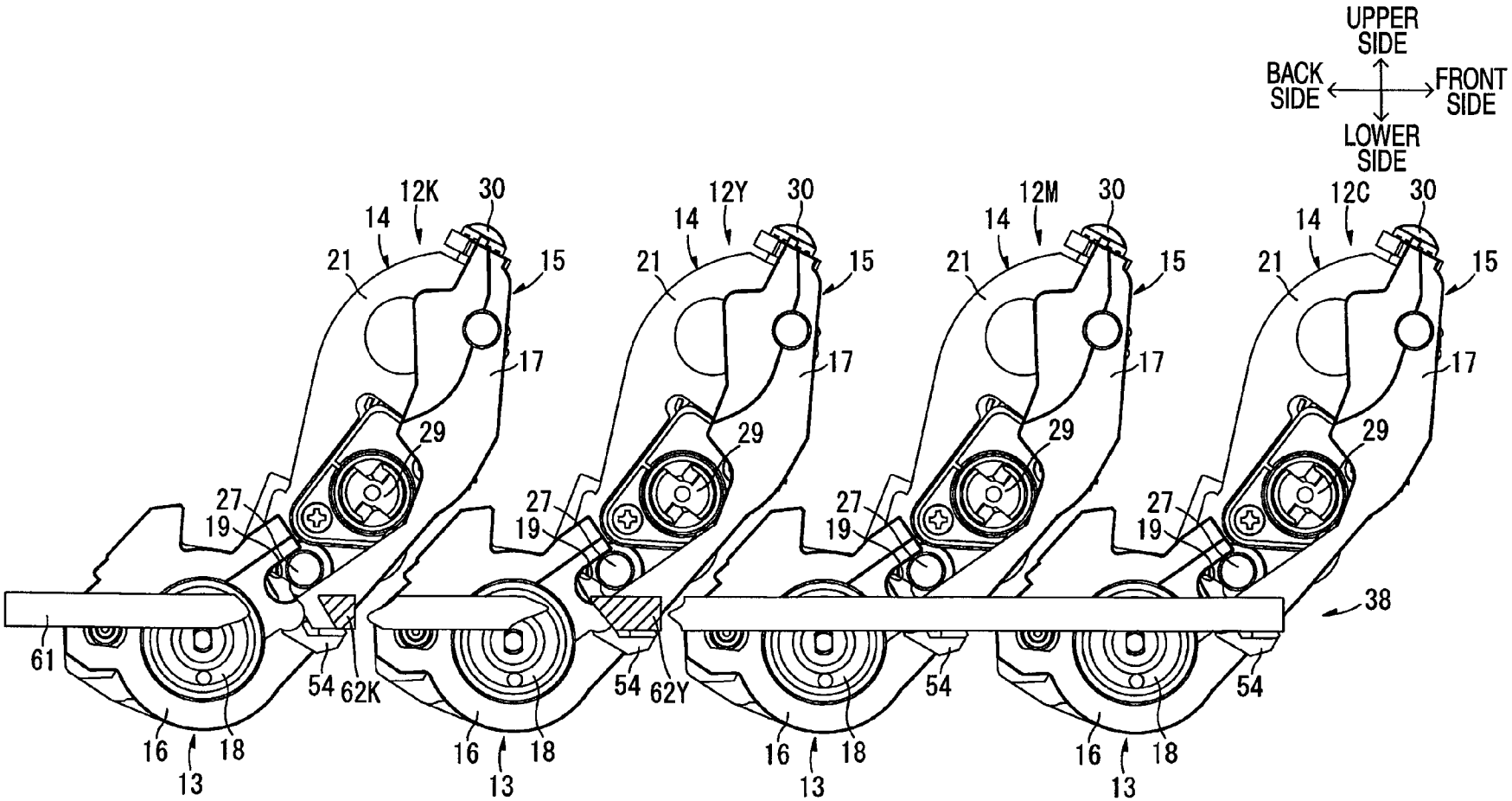
FIG. 14 is a left side view of the body casing of FIG. 9 in the standby mode.

In the standby mode, as shown in FIG. 13 and FIG. 14, the slide plate 61 is further slid backward by the stepping motor and positioned at the all contact position (backmost position) at which all pressing portions 62 press the corresponding swing levers 54 downward.

When the slide plate 61 is in the backmost position, all pressing portions 62 press all corresponding swing levers 54 downward, so that as described above, the swing levers 54 lift all roller shafts 27 to the upper front side. Then, all developing cartridges 14 are lifted to the upper front side against the pressing forces of the pressed portions 30, and the developing rollers 6 and all photosensitive drums 3K, 3Y, 3M, and 3C are separated from each other.

Accordingly, when an image is not being formed, all photosensitive drums 3K, 3Y, 3M, and 3C are separated from their corresponding developing rollers 6.

Then, the slide plate 61 is slid in the front-back direction by the stepping motor as described above, and positioned at the all-separated position (forefront position), the black separated position (intermediate position), and the all contact position (backmost position) during one reciprocation (one stroke).

During one reciprocation of the slide plate 61, the three-color side pressing portions 62YMC come into contact with the swing levers 54 twice continuously (for example, for a long period of time) at the black separated position (intermediate position) and the all contact position (backmost position).

In contrast, during one reciprocation of the slide plate 61, the black side pressing portion 62K comes into contact with the swing lever 54 once (for a short period of time) at the all contact position (backmost position).

In the image forming apparatus 1 of the second exemplary embodiment, for positioning the process cartridges 12 with respect to the body casing 2, the protrusions 42 (not shown) of the drum side press levers 40 (not shown) also press the drum side input couplings 18 to the lower back side to bring the drum side input couplings 18 into contact with the two positioning portions 39 on the lower sides and the back sides.

In contrast, to separate the developing rollers 6 from the photosensitive drums 3, the slide plate 61 is slid by the stepping motor such that the pressing portions 62 press the swing levers 54 downward. Then, the swing levers 54 lift the roller shafts 27 to the upper front side and the developing rollers 6 are separated from the photosensitive drums 3.

In the image forming apparatus 1, with respect to the positioning portions 39, the positioning direction in which the drum side press levers 40 press the drum side input couplings 18 to the lower back side and the acting direction in which the pressing portions 62 press the swing levers 54 downward are substantially the same downward direction.

Therefore, even when the developing rollers 6 are separated from the photosensitive drums 3 after the process cartridges 12 are positioned in the body casing 2, the positioning direction and the acting direction are substantially the same, so that the positional deviation of the process cartridges 12 with respect to the body casing 2 and vibration can be suppressed. As a result, deterioration of image forming accuracy is prevented, and the correction time when forming an image can be shortened.

In the separation mechanism 38, by pressing by the pressing portions 62, the swing levers 54 swing, and the back end portions of the swing levers 54 press the roller shafts 27, and accordingly, the developing cartridges 14 are moved in a direction in which the developing rollers 6 separate from the photosensitive drums 3. Therefore, by swinging the swing levers 54, the developing rollers 6 can be easily and reliably separated from the photosensitive drums 3.

In the separation mechanism 38, the pressing portions 62 press the swing levers 54. Therefore, by swinging the swing levers 54, the developing rollers 6 can be easily and reliably separated from the photosensitive drums 3. In addition, the slide plate 61 extends along the front-back direction orthogonal to the axial directions of the support shafts 53, so that downsizing in the axial directions (that is, the width direction) of the support shafts 53 is realized.

In the separation mechanism 38, by sliding one slide plate 61, the pressing portions 62 corresponding to the four developing cartridges 14 move in the front-back direction and press the corresponding swing levers 54. Then, due to swinging of the swing levers 54, the corresponding roller shafts 27 are pressed and the developing cartridges 14 are moved in the direction in which the developing rollers 6 separate from the photosensitive drums 3. Therefore, by sliding one slide plate 61, all developing cartridges 14 can be moved in the direction in which the developing rollers 6 separate from the photosensitive drums 3.

Further, in the separation mechanism 38, by sequentially changing the position in the front-back direction of the slide plate 61 by the stepping motor, at the all contact position (backmost position), all pressing portions 62 press the corresponding swing levers 54 downward. Therefore, the developing rollers 6 can be separated from all photosensitive drums 3K, 3Y, 3M, and 3C.

At the black separated position (intermediate position), the three-color side pressing portions 62YMC press the corresponding swing levers 54 downward, and in contrast, the contact of the black side pressing portion 62K with respect to the swing lever 54 is released. Therefore, with respect to only the photosensitive drum 3K for black, the corresponding developing roller 6 can be brought into pressure contact.

At the all-separated position (forefront position), all pressing portions 62 separate from the corresponding swing levers 54. Therefore, with respect to all photosensitive drums 3, corresponding developing rollers 6 can be brought into contact.

As a result, by a simple structure in which the slide plate 61 is slid, the separation modes of the developing rollers 6 with respect to the photosensitive drums 3, that is, the standby mode, the monochrome mode, and the full-color mode can be switched.

The black side pressing portion 62K comes into contact with the swing lever 54 once (for a short period of time) during one reciprocation of the slide plate 61, and the three-color side pressing portions 62YMC come into contact with the swing levers 54 twice continuously (for a long period of time) during one reciprocation of the slide plate 61, and accordingly, the separation modes can be switched by a simple structure.

In other words, the lower end face of the black side pressing portion 62K is formed to be shorter in the front-back direction than the lower end faces of the three-color side pressing portions 62YMC, and by a simple structure in which the lengths of the lower end faces are changed, the switching of the separation modes can be realized.

(Modified Exemplary Embodiments)

The above-described exemplary embodiments of the inventive concept have been described in relation to a direct tandem type color printer including four photosensitive drums. Alternatively, the invention may be applied to an intermediate transfer tandem type color printer or a monochrome printer. Alternatively, the invention may be applied to a printer including more or fewer than four photosensitive drums.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

an apparatus body;

a process cartridge that is configured to be removably mounted to the apparatus body and comprises:

a photosensitive cartridge comprising a photosensitive member; and a developing cartridge comprising a developer carrying member, which is contactable with the photosensitive member, and which is configured to carry developer;

a first pressing member that is configured to press the photosensitive cartridge in a first direction with respect to a positioning portion that is provided on the apparatus body; and a separating member that comprises a second pressing member that is configured to act in a second direction such that the separating member separates the developer carrying member from the photosensitive member, wherein the first direction and the second direction are substantially the same.

2. The image forming apparatus according to claim 1, wherein the developing cartridge comprises a protrusion, wherein the separating member further comprises:

a support shaft; and a swing lever that is rotatably supported by the support shaft, one side of the swing lever being contactable with the protrusion and another side of the swing lever being configured to be pressed by the second pressing member in the second direction so as to rotate the swing lever such that the one side of the swing lever presses the protrusion to separate the developer carrying member from the photosensitive member.

3. The image forming apparatus according to claim 2, wherein the second pressing member comprises:

a rotation shaft that is rotatable and extends along a direction orthogonal to an axial direction of the support shaft; and a press lever that is provided on the rotation shaft and presses the other side of the swing lever.

4. The image forming apparatus according to claim 3, further comprising:

a color process cartridge that is configured to be removably mounted to the apparatus body and comprises:

a color photosensitive cartridge comprising a color photosensitive member; and a color developing cartridge comprising a color protrusion and a color developer carrying member, which is contactable with the color photosensitive member, and which is configured to carry color developer;

a first color pressing member that is configured to be the color photosensitive cartridge in the first direction; and a color separating member that comprises:

a second color pressing member that is configured to act in the second direction such that the color separating member separates the color developer carrying member from the color photosensitive member;

a color support shaft; and a color swing lever that is rotatably supported by the color support shaft, one side of the color swing lever being contactable with the color protrusion and another side of the color swing lever configured to be pressed by the second color pressing member in the second direction so as to rotate the color swing lever such that the one side of the color swing lever presses the color protrusion of the color process cartridge to separate the color developer carrying member from the color photosensitive member, wherein the second color pressing member comprises the rotation shaft and a color press lever that is provided on the rotation shaft and configured to press the another side of the color swing lever, wherein the rotation shaft supports the press lever and the color press lever along a direction in which the developing cartridges and the color developing cartridge are arranged.

5. The image forming apparatus according to claim 4, wherein the rotation shaft is rotatable among:

a first position in which both the press lever and the color press lever are brought into contact with the corresponding swing levers;

a second position in which only one of the press lever and the color press lever are brought into contact with its corresponding swing lever; and a third position in which neither the press lever nor the color press lever is brought into contact with their corresponding swing levers.

6. The image forming apparatus according to claim 5, wherein one of the press lever and the color press lever is configured to contact with its corresponding swing lever once per rotation of the rotation shaft, and wherein the other one of the press lever and the color press lever is configured to contact with its corresponding swing lever twice per rotation of the rotation shaft.

7. The image forming apparatus according to claim 6,
wherein the one of the press lever and the color press lever that is configured to contact once per rotation comprises one contact portion, and
wherein the one of the press lever and the color press lever that is configured to contact twice per rotation comprises two contact portions which contact with its corresponding swing lever.

8. An image forming apparatus comprising:
an apparatus body;
a plurality of process cartridges that are configured to be removably mounted to the apparatus body, each of the plurality of process cartridges comprising:
a photosensitive cartridge comprising a photosensitive member; and
a developing cartridge, which is configured to be removably mounted in the photosensitive cartridge, and which comprises a developer carrying member, which is contactable with the photosensitive member and is configured to carry developer;
a plurality of first pressing members that are provided on the apparatus body and that correspond to the plurality of photosensitive cartridges, each of the first pressing members being configured to press its corresponding photosensitive cartridge into the apparatus body to secure the corresponding photosensitive cartridge in the apparatus body;
a side plate that is provided outside of the process cartridge;
an elongated member that is attached to an outside of the side plate and extends along the plurality of process cartridges in a direction orthogonal to a direction of the axes of the photosensitive members; and
a plurality of second pressing members, which correspond to the plurality of process cartridges, each second pressing member being positioned along the elongated member so as to, when actuated, cause the developer carrying member to separate from the photosensitive member.

9. The image forming apparatus according to claim 8, wherein the elongated member comprises a rotation shaft which is configured to be rotated to activate the plurality of second pressing members.

10. The image forming apparatus according to claim 9, wherein the rotation shaft is rotatable among:
a first position in which all the second pressing members are activated at the same time;
a second position in which only one of the second pressing members is activated; and
a third position in which none of the second pressing members is activated.

11. The image forming apparatus according to claim 9, further comprising:
a plurality of support shafts, corresponding to the process cartridges; and
a plurality of swing levers, each swing lever rotatably mounted to a respective one of the support shafts, and
wherein, when activated, the second pressing members are configured to press a respective one of the swing levers in order to rotate the swing lever and cause the corresponding developer carrying member to separate from the corresponding photosensitive member.

12. The image forming apparatus according to claim 8, wherein the elongated member comprises a slide plate which is configured to slide along the direction orthogonal to the axes of the process cartridges in order to activate the plurality of second pressing members.

13. The image forming apparatus according to claim 12, wherein the rotation shaft is slidable among:
a first position in which all the second pressing members are activated at the same time;
a second position in which only one of the second pressing members is activated; and
a third position in which none of the second pressing members is activated.

14. The image forming apparatus according to claim 12, further comprising:
a plurality of support shafts, corresponding to the process cartridges; and
a plurality of swing levers, each swing lever rotatably mounted to a respective one of the support shafts, and
wherein, when activated, the second pressing members press a respective one of the swing levers in order to rotate the swing lever and cause the corresponding developer carrying member to separate from the corresponding photosensitive member.

15. An image forming apparatus comprising:
an apparatus body;
a process cartridge that is configured to be removably mounted to the apparatus body and comprises:
a photosensitive cartridge comprising a photosensitive member; and
a developing cartridge comprising a developer carrying member, which is contactable with the photosensitive member, and which is configured to carry developer; and
a separating member that comprises a pressing member that is configured to act in a first direction to cause the developer carrying member to separate from the photosensitive member in a second direction,
wherein the first direction is substantially opposite to the second direction.

16. An image forming apparatus comprising:
an apparatus body;
a process cartridge that is configured to be removably mounted to the apparatus body and comprises:
a photosensitive unit comprising:
a photosensitive member; and
a drum side input coupling configured to receive a driving force to be input to the photosensitive member; and
a developing unit comprising:
a developer carrying member, which is contactable with the photosensitive member, and which is configured to carry developer; and
a developing side input coupling configured to receive a driving force to be input to the developer carrying member; and
a separating member that comprises a pressing member that is configured to act in a first direction to cause the developer carrying member to separate from the photosensitive member in a second direction,
wherein the first direction is substantially opposite to the second direction.

17. An image forming apparatus comprising:
an apparatus body;
a process cartridge that is configured to be removably mounted to the apparatus body and comprises:
a photosensitive unit comprising a photosensitive member; and
a developing unit comprising:
a developer carrying member, which is contactable with the photosensitive member, and which is configured to carry developer; and
a protrusion; and
a separating member that comprises a pressing member that is configured to act in a first direction to cause the developer carrying member to separate from the photosensitive member in a second direction,
wherein the first direction is substantially opposite to the second direction.

* * * * *